US011636961B2

(12) United States Patent
Yamauchi et al.

(10) Patent No.: US 11,636,961 B2
(45) Date of Patent: Apr. 25, 2023

(54) VARIABLE RESISTOR AND ELECTRONIC DEVICE

(71) Applicant: DENSO CORPORATION, Kariya (JP)

(72) Inventors: Shunji Yamauchi, Kariya (JP); Tatsuzou Suzuki, Obu (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/542,727

(22) Filed: Dec. 6, 2021

(65) Prior Publication Data

US 2022/0181051 A1 Jun. 9, 2022

(30) Foreign Application Priority Data

Dec. 8, 2020 (JP) ..... JP2020-203693

(51) Int. Cl.
*H01C 10/32* (2006.01)
*H01C 10/16* (2006.01)

(52) U.S. Cl.
CPC ..... *H01C 10/32* (2013.01); *H01C 10/16* (2013.01)

(58) Field of Classification Search
CPC ..... H01C 10/34; H01C 1/14; H01C 10/32; H01C 10/16; H01C 1/01
USPC ..... 338/147, 171
See application file for complete search history.

(56) References Cited

U.S. PATENT DOCUMENTS 4,069,466 A * 1/1978 Williams ..... H01C 10/32 338/202
7,583,177 B1 * 9/2009 Fan ..... H01C 10/48 338/162

FOREIGN PATENT DOCUMENTS

| | | | |
|---|---|---|---|
| JP | H05-052643 | B2 | 8/1993 |
| JP | H08-114410 | A | 5/1996 |
| JP | H09-193646 | A | 7/1997 |
| JP | 3535415 | B2 | 6/2004 |
| JP | 4283159 | B2 | 6/2009 |
| JP | 6482883 | B2 | 3/2019 |

* cited by examiner

*Primary Examiner* — Edwin A. Leon
*Assistant Examiner* — Iman Malakooti
(74) *Attorney, Agent, or Firm* — Posz Law Group, PLC

(57) ABSTRACT

A variable resistor includes: a main body and a rotating part vertically separated away from each other, among which the main body includes: a substrate having a first main surface, a second main surface and a through hole vertically penetrating the first main surface and the second main surface; a first conductive portion and a second conductive portion provided on the first main surface; a resistor body connected thereto; an electrode positioned closer to the through hole than the resistor body; and a third conductive portion (i) provided on each of the second main surface and a partition wall surface for partitioning the through hole and (ii) connected to the electrode, and the rotating part includes: an opposing part rotatable in a circumferential direction; and a slider configured to conductively slide as the rotating part rotates.

15 Claims, 20 Drawing Sheets

VARIABLE RESISTOR AND ELECTRONIC DEVICE

CROSS REFERENCE TO RELATED APPLICATION

The present application is based on and claims the benefit of priority of Japanese Patent Application No. 2020-203693, filed on Dec. 8, 2020, the disclosure of which is incorporated herein by reference.

TECHNICAL FIELD

The present disclosures generally relates to variable resistors and electronic devices.

BACKGROUND INFORMATION

A conventional potentiometer has (i) a resistor body extending in a spiral shape from one end, i.e., a start end, to the other end, i.e., a terminal end, (ii) a start terminal attached to the start end of the resistor body, (iii) an end terminal attached to the terminal end of the resistor body, and (iv) an inner peripheral wiper and an outer peripheral wiper respectively sliding on the resistor body.

SUMMARY

It is an object of the present disclosure to provide a variable resistor and an electronic device in which an increase in the number of components is suppressed.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Figure 1:
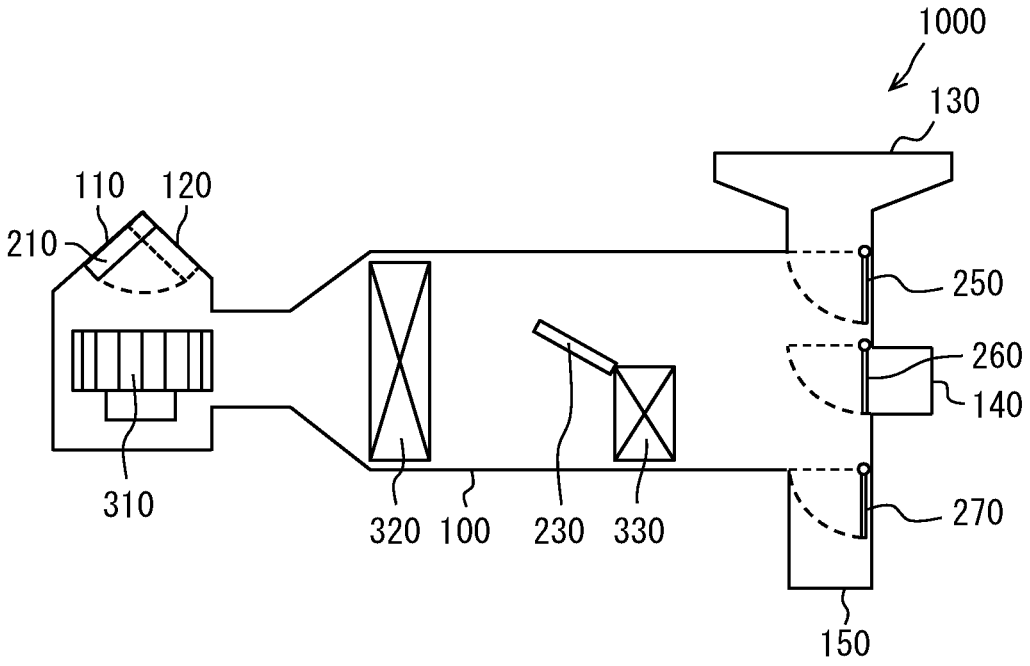
FIG. 1 is a schematic view illustrating a vehicle air conditioner.

Hereinafter, a plurality of embodiments for carrying out the present disclosure will be described with reference to the drawings. In each of the embodiments, parts corresponding to the elements described in the preceding embodiment(s) are denoted by the same reference numerals, and redundant explanation may be omitted. When only a part of a configuration is described in an embodiment, an un-described part of the configuration is supplemented by, i.e., with reference to, the preceding embodiment.

In addition, not only the combination of the parts that explicitly indicate as combinable in each of the embodiments, but also the combination of the embodiments, of the embodiment and the modification(s), and of the modifications is possible unless otherwise described as problematic.

First Embodiment

In the following, an example where an electronic device 700 controls each of motor devices provided in a vehicle air conditioner 1000 will be described. However, the motor device controlled by the electronic device 700 is not limited to the devices provided in the vehicle air conditioner 1000. Other motor devices mounted on the vehicle may also be controlled by the electronic device 700. The electronic device 700 may control a motor device for adjusting an opening degree of a valve device such as a three-way valve that switches a flow of a liquid such as engine cooling water. Alternatively, a motor device mounted on a vehicle other than a vehicle may also be controlled by the electronic device 700.

In FIG. 1, the vehicle air conditioner 1000 is mounted on a vehicle. The vehicle is, for example, an automobile equipped with a gasoline-powered engine. However, as a vehicle, an electric vehicle equipped with a traveling motor, a hybrid vehicle equipped with both an engine and a motor, and the like can also be adopted. The vehicle air conditioner 1000 is a device that adjusts temperature of a taken-in air and blows it out into a vehicle interior. In other words, the vehicle air conditioner 1000 is a device that performs air conditioning operations such as heating operation, cooling operation, and dehumidifying operation in the vehicle interior.

The vehicle air conditioner 1000 includes an air-conditioning case 100 in which an air path through which airflows is formed. The air-conditioning case 100 houses various devices used for air-conditioning operation in its inside. The air-conditioning case 100 is formed with two air intake ports, i.e., an inside air intake 110 and an outside air intake 120. The air-conditioning case 100 is formed with a defroster outlet 130 that blows air-conditioning air to a front window of the vehicle. The air-conditioning case 100 is formed with a face outlet 140 that blows air-conditioning air above front seats. The air-conditioning case 100 is formed with a foot outlet 150 that blows air-conditioning air at a lower part of the front seats.

The vehicle air conditioner 1000 includes a blower 310, an evaporator 320, and a heater core 330. The blower 310 is a device for flowing/blowing air into the air-conditioning case 100. The evaporator 320 is a heat exchanger, in an inside of which a refrigerant flows, for cooling the air by removing heat of vaporization from the surrounding air when the refrigerant vaporizes from a liquid to a gas. The heater core 330 is a heat exchanger in which high-temperature engine cooling water flows inside and heats the surrounding air using heat of the engine cooling water. However, instead of the heater core 330, an electric heater or the like that consumes electric power to heat the air may be used, or both of the heater core 330 and the electric heater may be used in combination.

The vehicle air conditioner 1000 includes an inside/outside air switching door 210 for opening/closing the inside air intake 110 and the outside air intake 120. The inside/outside air switching door 210 is a door device that adjusts an amount of air introduced into the air-conditioning case 100 from the inside air intake 110 and the outside air intake 120. The door device is also called as a flap device. The door device is also called as a damper device.

The inside/outside air switching door 210 realizes an inside air mode in which the air-conditioning air is circulated in the vehicle by opening the inside air intake 110 and closing the outside air intake 120. The inside/outside air switching door 210 realizes an outside air mode in which the air-conditioning air is taken in from the outside of the vehicle by closing the inside air intake 110 and opening the outside air intake 120. However, in the outside air mode, the inside air intake 110 does not have to be completely closed. For example, by slightly opening the inside air intake 110, the inside air may be taken in at a smaller rate than the outside air for circulating the air.

The vehicle air conditioner 1000 includes an air mix door 230 for adjusting the temperature of the air-conditioning air. The air mix door 230 is provided downstream of the evaporator 320 and upstream of the heater core 330 in the air flow inside the air-conditioning case 100. By controlling the opening degree of the air mix door 230, the amount of air that passes through the heater core 330 and is heated can be adjusted.

The vehicle air conditioner 1000 includes a defroster door 250 for opening and closing the defroster outlet 130. The defroster door 250 is a door device that adjusts the presence or absence of air-conditioning air blown from the defroster outlet 130 and the amount of blown air therefrom. The vehicle air conditioner 1000 includes a face door 260 for opening and closing the face outlet 140. The face door 260 is a door device that adjusts the presence or absence of air-conditioning air blown out from the face outlet 140 and the amount of blown air therefrom. The vehicle air conditioner 1000 includes a foot door 270 for opening and closing the foot outlet 150. The foot door 270 is a door device that adjusts the presence/absence and the amount of air-conditioning air blown out from the foot outlet 150.

The vehicle air conditioner 1000 includes five outlet modes: defroster mode, face mode, foot mode, bi-level (B/L) mode, and foot defroster (F/D) mode. However, the types of outlet modes are not limited to the above-described five modes. The defroster door 250, the face door 260, and the foot door 270 are door devices for switching modes in the vehicle air conditioner 1000, and are also called mode doors. In the drawings, the defroster mode is shown as "DEF", the face mode is shown as "FACE", the foot mode is shown as "FOOT", the bi-level mode is shown as "B/L", and the foot defroster mode is shown as "F/D".

The inside/outside air switching door 210 can rotate in a range from a state where the inside air intake 110 is closed to a state where the outside air intake 120 is closed. A rotatable angle of the inside/outside air switching door 210 is, for example, 100°. The air mix door 230 can rotate in a range from a state in which the amount of air passing through the heater core 330 is minimized to a state in which the amount of air not passing through the heater core 330 is minimized. The rotatable angle of the air mix door 230 is, for example, 180°.

The defroster door 250 can rotate in a range from a state in which the defroster outlet 130 is closed to a state in which the defroster outlet 130 is completely open. A rotatable angle of the defroster door 250 is, for example, 90°. The face door 260 can rotate in a range from a state in which the face outlet 140 is closed to a state in which the face outlet 140 is completely open. A rotatable angle of the face door 260 is, for example, 90°. The foot door 270 can rotate in a range from a state in which the foot outlet 150 is closed to a state in which the foot outlet 150 is completely open. A rotatable angle of the foot door 270 is, for example, 90°.

Three mode doors including the defroster door 250, the face door 260 and the foot door 270 may be configured as one continuous door device. For example, a rotary door that opens and closes each of the outlets by rotating a door plate portion formed in an arcuate face shape may be adopted as the continuous door device. In such case, one door plate portion has functions as three door devices of the defroster door 250, the face door 260, and the foot door 270. A rotatable angle of the rotary door is, for example, 300°.

The inside/outside air switching door 210, the air mix door 230, the defroster door 250, the face door 260, and the foot door 270 are door devices in which an angle of the door plate portion is adjusted by a servomotor. Since the flow rate of air in the door plate portion changes depending on the angle of the door plate portion, it is preferable to control the position of the angle of the door plate portion of each door device with as high accuracy as possible.

Figure 2:
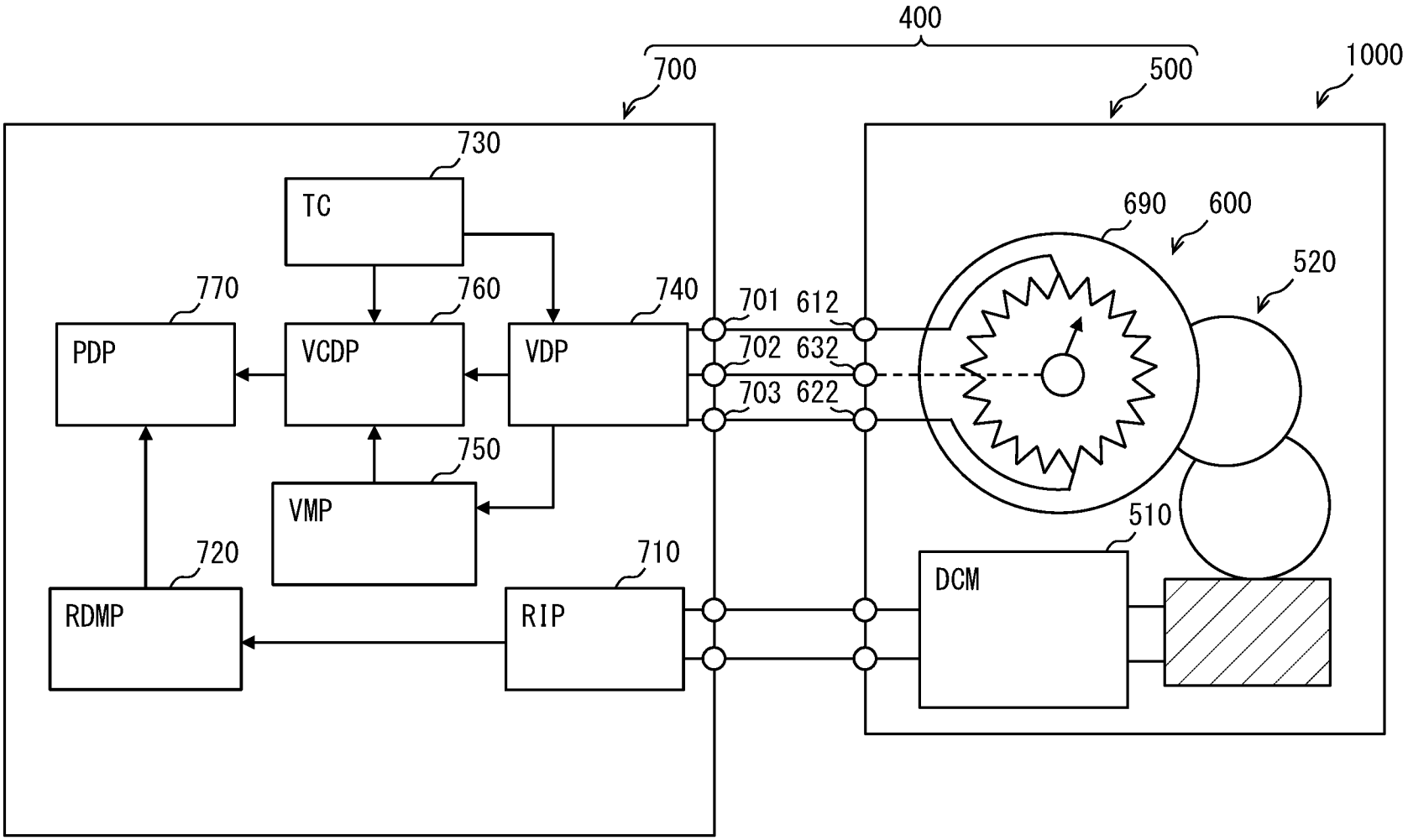
FIG. 2 is a schematic diagram illustrating a control system.

In FIG. 2, the control system 400 includes an actuator 500 and an electronic device 700. The actuator 500 includes a DC motor 510, a speed reduction unit 520, and a variable resistor 600. The variable resistor 600 has a rotating part 690. The DC motor 510 is a servomotor to be controlled by the electronic device 700. The DC motor 510 is a motor that can easily obtain a larger torque than a stepping motor. Note that, in the drawings, the DC motor 510 is abbreviated as "DCM."

The DC motor 510 includes a stator having a permanent magnet that functions as a field magnetic pole. The DC motor 510 has an air gap on an inner circumference of the field magnetic pole and includes a rotor. The DC motor 510 includes a commutator on the same axis as the rotor. The commutator is also called a commutator. The DC motor 510 includes a brush for contacting the commutator and passing a current through the commutator. The DC motor 510 is configured such that the commutator in contact with the brush is constantly switched by being rotationally driven.

The speed reduction unit 520 is a portion that decelerates the rotation of the DC motor 510 and transmits the rotation to the rotating part 690. The speed reduction unit 520 can adjust the torque and rotation number required for the actuator 500. The speed reduction gear 520 includes a plurality of gears including a worm gear.

The rotating part 690 is a portion of the actuator 500 that outputs a driving force to the outside. The rotating part 690 is connected to the door device of the vehicle air conditioner 1000 via a link (not shown) or the like. The door device rotates with the rotation of the rotating part 690. Each of the outlets can be opened and closed as the rotating part 690 rotates.

The variable resistor 600 is a device that detects the amount of rotation of the rotating part 690. The resistance value acquired by the variable resistor 600 changes according to the amount of rotation of the rotating part 690. A predetermined voltage is applied to the variable resistor 600. The variable resistor 600 can detect a voltage corresponding to the resistance value. The configuration of the variable resistor 600 will be described in details below.

<Configuration of Variable Resistor>

The mechanical configuration of the variable resistor 600 will be described. Three directions orthogonal to one another are referred to as an X direction, a Y direction, and a Z direction. The Z direction corresponds to one direction, and is also known as a vertical direction.

As shown in FIGS. 3 to 8, the variable resistor 600 has a main body 670 and a rotating part 690. The main body 670 has a substrate 640, a first conductive portion 610, a second conductive portion 620, a third conductive portion 630, a resistor body pattern 650, an electrode 660, and a case 675. The first conductive portion 610 has a first conductive pattern 611 and a first conductive terminal 612. The second conductive portion 620 has a second conductive pattern 621 and a second conductive terminal 622. The third conductive portion 630 has a third conductive pattern 631 and a third conductive terminal 632. Note that the resistor body pattern 650 corresponds to a resistor body.

In the drawings, the first conductive pattern 611, the second conductive pattern 621, the electrode 660, and the resistor body pattern 650 are respectively shown as hatched in the top view, for the ease of distinction from each other.

Figure 3:
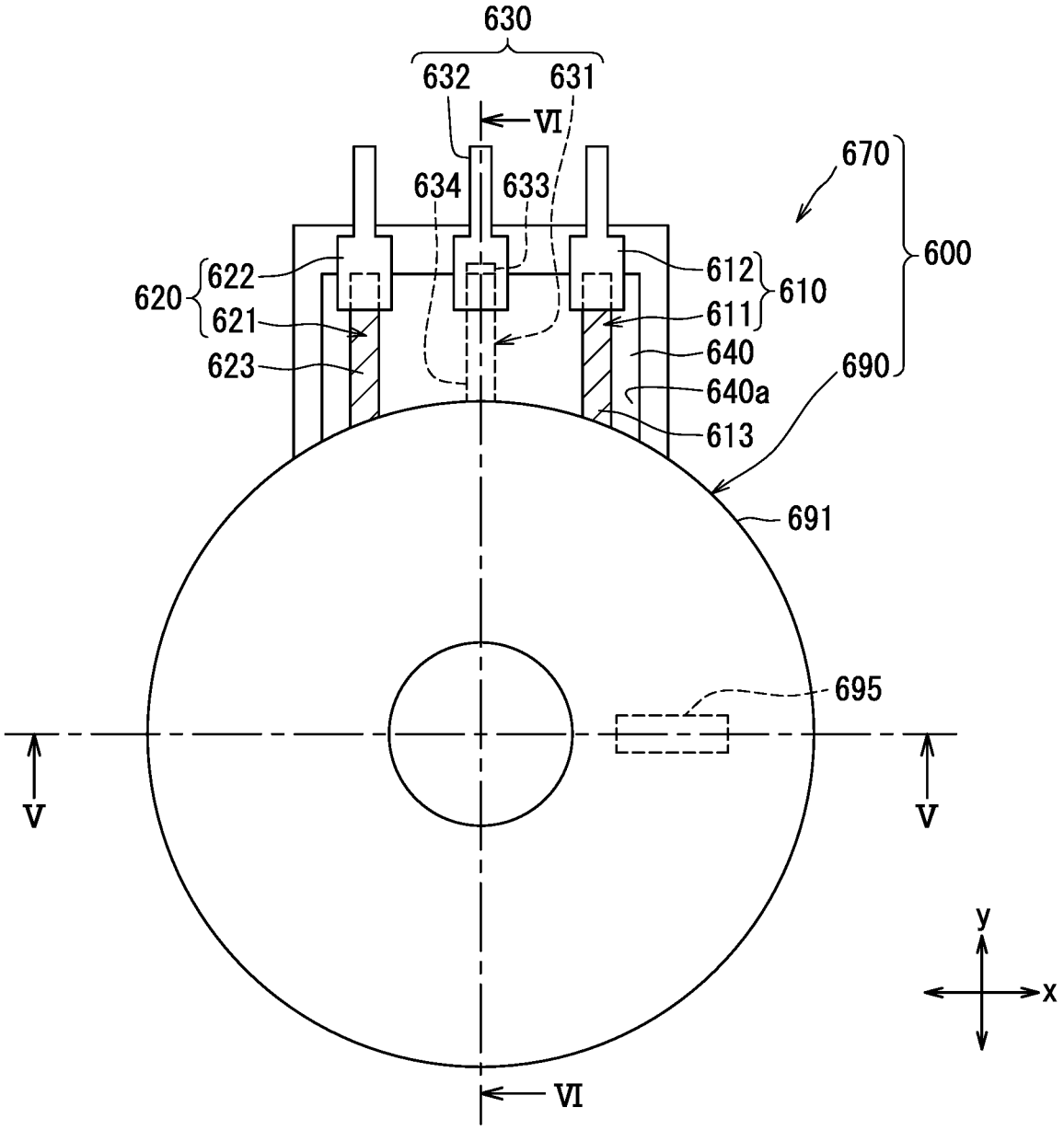
FIG. 3 is a top view illustrating a variable resistor.
Figure 4:
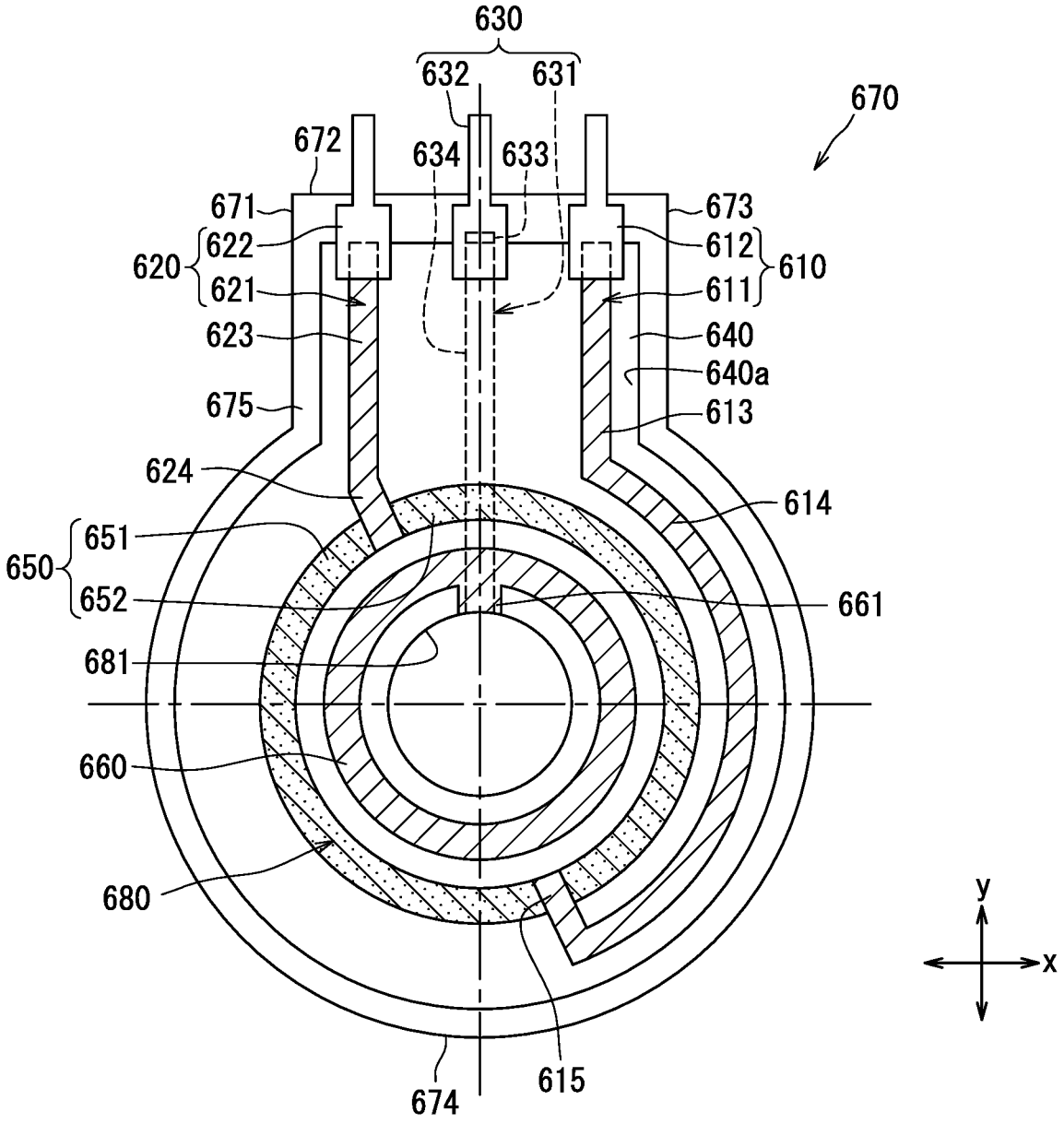
FIG. 4 is a top view of the variable resistor shown in FIG. 3 excluding a rotating part.

Further, in order to show which position of the main body 670 the cross-sectional line shown in FIG. 3 corresponds to, the cross-sectional line shown in FIG. 3 is also shown in FIG. 4.

Figure 5:
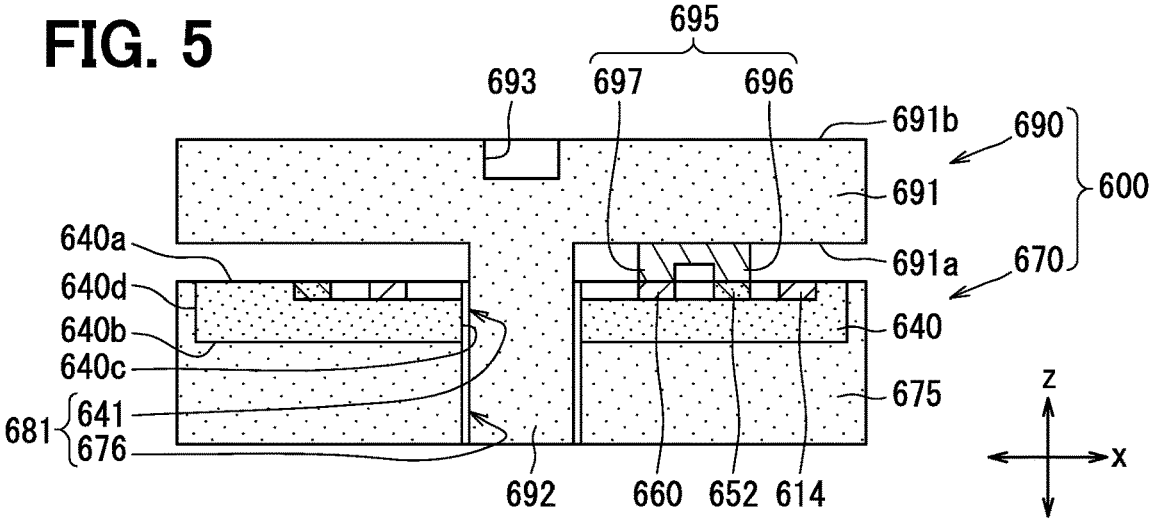
FIG. 5 is a cross-sectional view of the variable resistor along a V-V line shown in FIG. 3.
Figure 6:
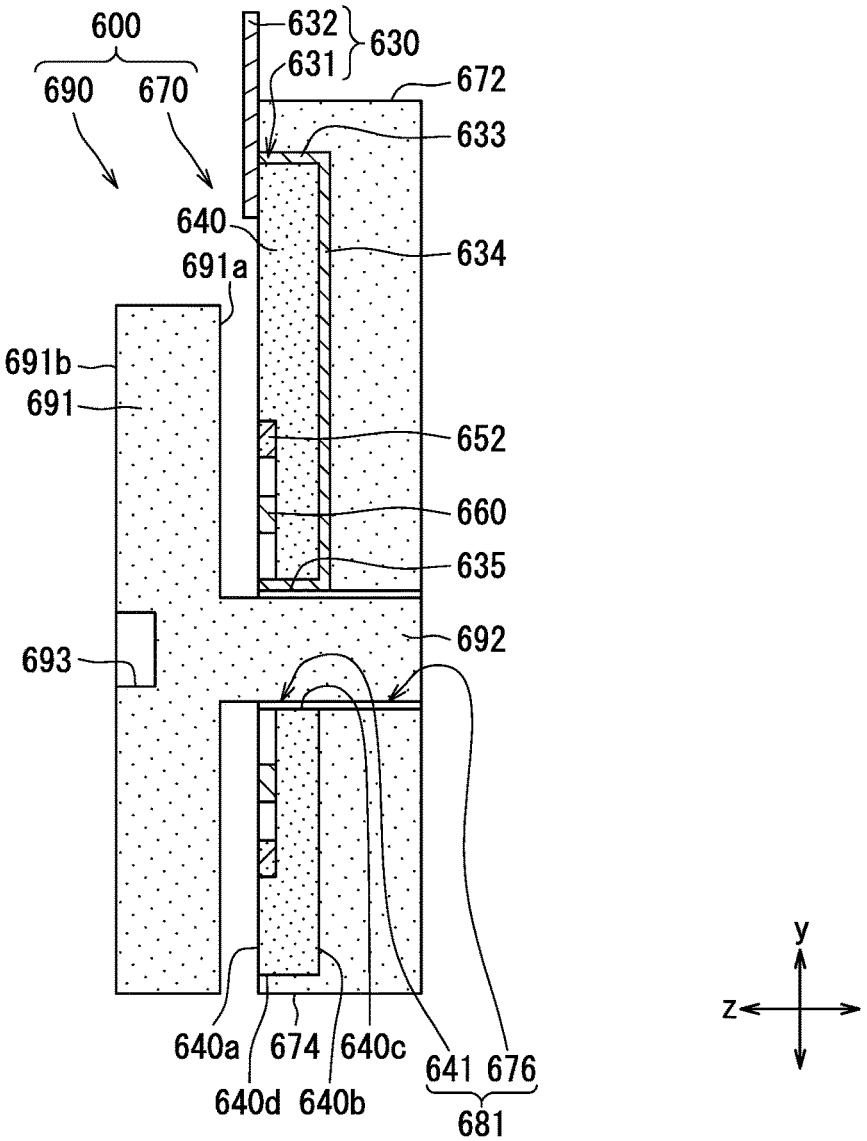
FIG. 6 is a cross-sectional view of the variable resistor along a VI-VI line shown in FIG. 3.

The substrate 640 has a flat shape having a thin thickness in the Z direction, which is made of, for example, glass epoxy. As shown in FIGS. 5 and 6, the substrate 640 has a first main surface 640*a* and a second main surface 640*b* arranged along the z direction. The substrate 640 has, formed thereon, a through hole 641 penetrating the first main surface 640*a* and the second main surface 640*b*. The through hole 641 is formed at the center in the radial direction. The first main surface 640*a* and the second main surface 640*b* are located on the through hole 641 side and are connected by a partition wall surface 640*c* that partitions the through hole 641 and a partition wall surface 640*c* and a connecting surface 640*d* which is arranged in a direction orthogonal to the Z direction.

The first conductive pattern 611, the second conductive pattern 621, the resistor body pattern 650, and the electrode 660 are respectively screen-printed on the first main surface 640*a*. The third conductive pattern 631 is screen-printed on each of the second main surface 640*b*, the partition wall surface 640*c*, and the connecting surface 640*d*.

The first conductive pattern 611, the second conductive pattern 621, and the third conductive pattern 631 are respectively a coating in which silver powder is dispersed in a binder such as phenol resin. Note that the first conductive pattern 611, the second conductive pattern 621, and the third conductive pattern 631 are not limited to the coating in which silver powder is dispersed in a binder such as phenol resin. The print patterns of the first conductive pattern 611, the second conductive pattern 621, and the third conductive pattern 631 will be described later.

The first conductive terminal 612, the second conductive terminal 622, and the third conductive terminal 632 are conductive members made of a metal material. The first conductive terminal 612 is electrically and mechanically connected to the first conductive pattern 611. The second conductive terminal 622 is electrically and mechanically connected to the second conductive pattern 621. The third conductive terminal 632 is electrically and mechanically connected to the third conductive pattern 631.

The resistor body pattern 650 is a coating in which carbon powder is dispersed in a binder such as phenol resin. Note that the resistor body pattern 650 is not limited to a coating in which carbon powder is dispersed in a binder such as phenol resin. The print pattern of the resistor body pattern 650 will be described later.

The electrode 660 is a coating in which silver powder is dispersed in a binder such as phenol resin. Note that the electrode 660 is not limited to a coating in which silver powder is dispersed in a binder such as phenol resin. The print pattern of the electrode 660 will be described later.

The case 675 is formed of an insulating resin member or the like. As shown in FIGS. 3 to 8, the case 675 has a one-body shape which is made up as a combination of a substantially rectangular parallelepiped body and a substantially cylindrical body lined up in the y direction. A case hole 676 is formed in the case 675 at the center of a substantially cylindrical portion in the radial direction.

The case 675 has a first wall portion 671 and a third wall portion 673 arranged apart from each other in the X direction in the substantially rectangular parallelepiped body. The case 675 has a second wall portion 672 that connects the first wall portion 671 and the third wall portion 673 in the substantially rectangular parallelepiped body. The case 675 has a fourth wall portion 674 that connects the first wall portion 671 and the third wall portion 673 on a substantially cylindrical body side.

Further, the substrate 640 is inserted into the case 675 so that the first main surface 640*a* is exposed therefrom. Similar to the case 675, the substrate 640 also has a shape which is made up as a combination of a substantially rectangular parallelepiped body having a thin thickness in the Z direction and a substantially cylindrical body arranged in the Y direction. The above-mentioned through hole 641 and the case hole 676 communicate with each other in the Z direction to form a communication hole 681.

The rotating part 690 includes: an opposing part 691 opposing or facing the case 675; a shaft portion 692 extending in the Z direction from an opposing surface 691*a* located on a case 675 side of the opposing part 691; and a slider 695 provided on the opposing surface 691*a* of the opposing part 691. As shown in FIGS. 5 and 6, the shaft portion 692 is passed through the communication hole 681 described above. The opposing part 691 can rotate 360° in the circumferential direction around the shaft portion 692. In other words, the opposing part 691 can rotate 360° in the circumferential direction around the Z direction.

Further, the opposing part 691 is provided with a recess 693 recessed toward the opposing surface 691*a* on a back surface 691*b* on the back side of the opposing surface 691*a*. The recess 693 is provided with an operation shaft (not shown). The opposing part 691 can rotate 360° in the circumferential direction in conjunction with the operation shaft. Note that the rotation of the opposing part 691 is not limited to the rotation by the operation shaft. The opposing part 691 may be directly connected to the speed reduction unit 520 to rotate in the circumferential direction in conjunction with the speed reduction unit 520. The speed reduction unit 520 may be provided on the operation shaft.

As described above, the slider 695 is provided on the opposing surface 691*a* of the opposing part 691. The slider 695 has a first sliding portion 696 and a second sliding portion 697 respectively extending from the opposing surface 691*a* toward the first main surface 640*a*. Note that FIGS. 7 and 8 show a form in which the slider 695 is projected onto the annular portion 680 and the electrode 660 in order to explain the sliding form involving the slider 695, the annular portion 680, and the electrode 660.

Figure 7:
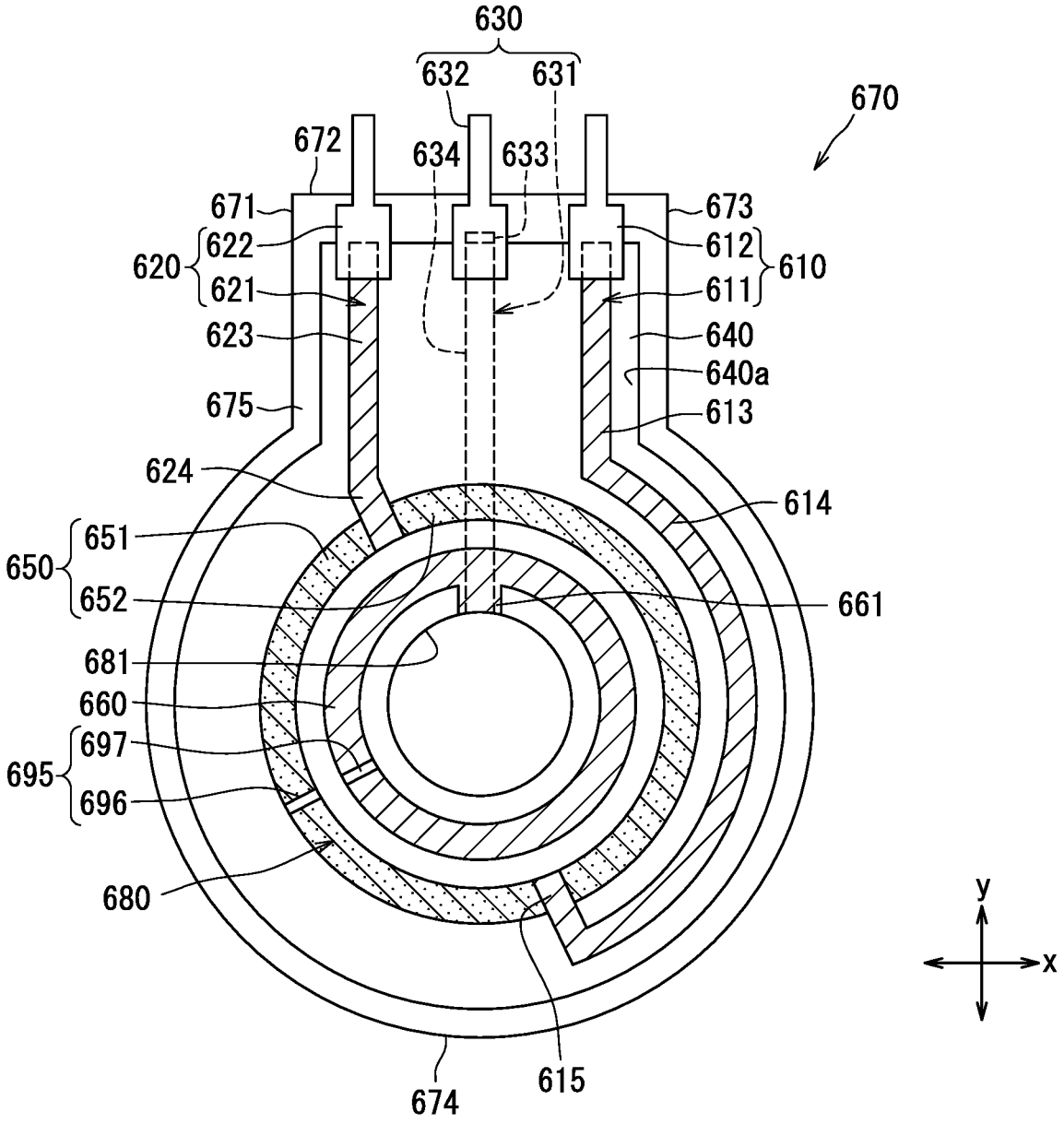
FIG. 7 is a top view for explaining sliding of a slider.
Figure 8:
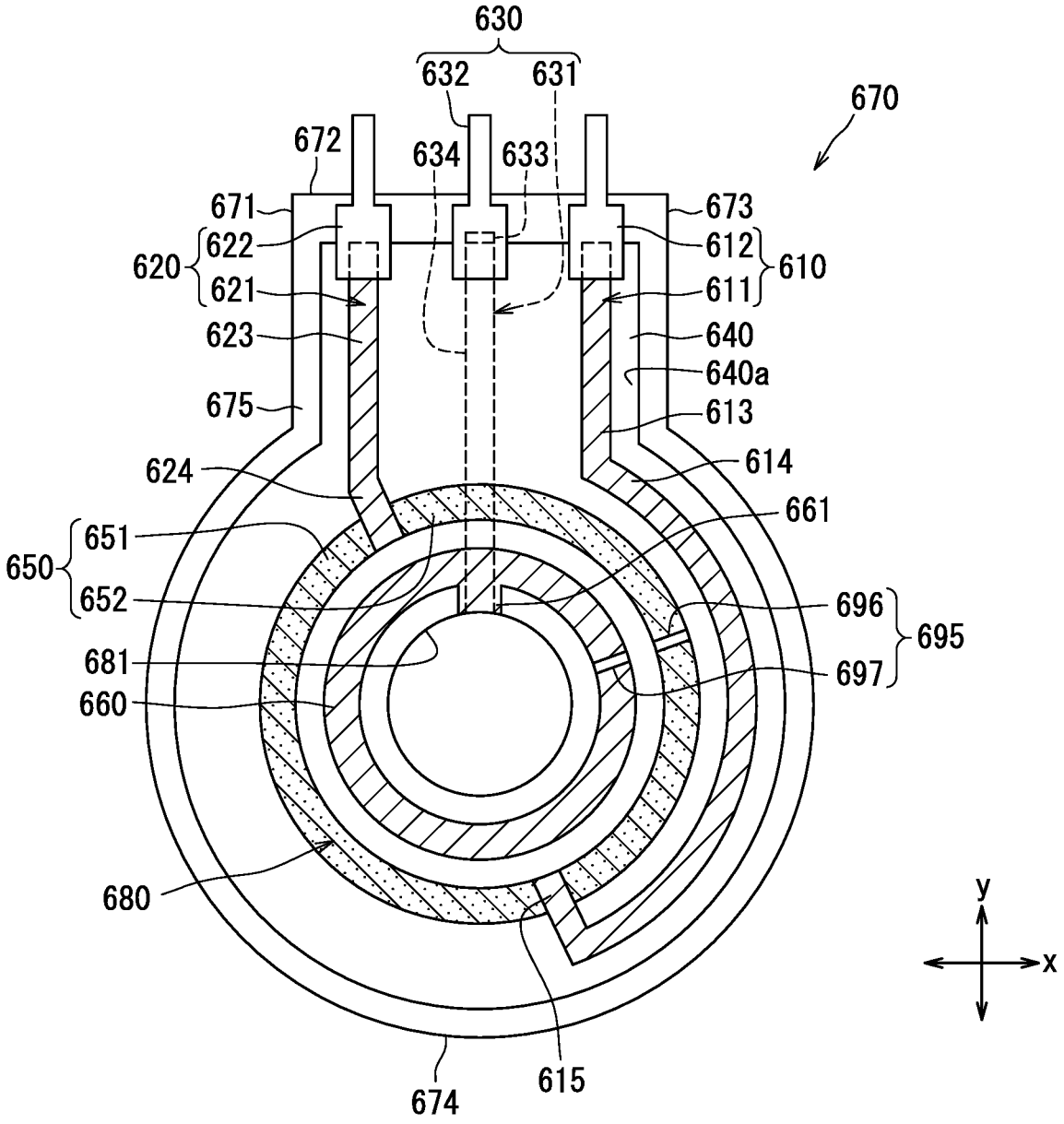
FIG. 8 is another top view for explaining sliding of the slider.

As shown in FIGS. 7 and 8, as the opposing part 691 included in the rotating part 690 rotates, the first sliding portion 696 slides (((conductively))) on one of the resistor body pattern 650, the first conductive pattern 611, and the second conductive pattern 621. As the opposing part 691 rotates, the second sliding portion 697 conductively slides on the electrode 660. Note that it is desirable that a width of a portion of the first sliding portion 696 in contact with one of the resistor body pattern 650, the first conductive pattern 611, and the second conductive pattern 621 is narrowed in the circumferential direction. It is also desirable that a width of a portion of the second sliding portion 697 in contact with the electrode 660 is narrowed in the circumferential direction.

<Print Pattern of Conductive Pattern>

As described above, the first conductive pattern 611 and the second conductive pattern 621 are printed on the first main surface 640*a* of the substrate 640.

As shown in FIGS. 4 to 8, the first conductive pattern 611 has a first extension portion 613, a second extension portion 614, and a first tip portion 615. The first extension portion 613 extends from a second wall portion 672 side to a fourth wall portion 674 side along the y direction. The second extension portion 614 extends in the circumferential direction from a tip of the first extension portion 613 along the fourth wall portion 674. The first tip portion 615 extends from a tip of the second extension portion 614 toward the communication hole 681. The first tip portion 615 is connected to a first resistor body pattern 651 on one end side in the circumferential direction. The first tip portion 615 is connected to a second resistor body pattern 652 on the other end side in the circumferential direction.

As shown in FIGS. 4 to 8, the second conductive pattern 621 includes: a third extension portion 623 extending from a second wall portion 672 side to a fourth wall portion 674 side in the y direction; and a second tip portion 624 that extends from a tip of the third extension portion 623 toward the communication hole 681. The second tip portion 624 is connected to the first resistor body pattern 651 on one end side. The second tip portion 624 is connected to the second resistor body pattern 652 on an other end side.

As shown in FIG. 4, the first tip portion 615 and the second tip portion 624 are printed on the first main surface 640*a* so as to be separated from each other by 180° in the circumferential direction. Note that the first tip portion 615 and the second tip portion 624 may be not printed on the first main surface 640*a* in such a manner that they are separated by 180° in the circumferential direction.

As shown in FIG. 6, the third conductive pattern 631 has a fourth extension portion 633, a fifth extension portion 634, and a sixth extension portion 635. The fourth extension portion 633 extends on the connecting surface 640*d* from the first main surface 640*a* toward the second main surface 640*b*. The fifth extension portion 634 extends on the second main surface 640*b* from a tip of the fourth extension portion 633 toward the through hole 641. The sixth extension portion 635 extends on the partition wall surface 640*c* from a tip of the fifth extension portion 634 toward the first main surface 640*a*. In such manner, the third conductive pattern 631 is screen-printed on the second main surface 640*b*, the partition wall surface 640*c*, and the connecting surface 640*d*, respectively.

<Extension and Conductive Terminals>

The first extension portion 613, the fourth extension portion 633, and the third extension portion 623 are arranged to be separated from (and substantially in parallel with) each other in the x direction from the third wall portion 673 toward the first wall portion 671. The first conductive terminal 612 is connected to the first extension portion 613. The third conductive terminal 632 is connected to the fourth extension portion 633. The second conductive terminal 622 is connected to the third extension portion 623.

A predetermined voltage is applied across the first conductive terminal 612 and the second conductive terminal 622. The predetermined voltage is, for example, 5 V. The predetermined voltage does not have to be 5 V.

Further, the first conductive terminal 612 is connected to a reference potential. The first conductive terminal 612 may be not connected to the reference potential. In such a case, the second conductive terminal 622 may be connected to the reference potential.

<Resistor Body Pattern and Electrode Print Pattern>

The resistor body pattern 650 has a first resistor body pattern 651 and a second resistor body pattern 652 connected to the first tip portion 615 and the second tip portion 624, respectively. The first resistor body pattern 651 is printed on the first main surface 640*a* in such a manner that it contacts one side of each of the first tip portion 615 and the second tip portion 624 in the circumferential direction. The second resistor body pattern 652 is printed on the first main surface 640*a* in such a manner that it contacts the other side of the first tip portion 615 and the second tip portion 624 in the circumferential direction. Therefore, the first resistor body pattern 651, the first tip portion 615, the second resistor body pattern 652, and the second tip portion 624 constitute the annular portion 680 that extends continuously in the circumferential direction.

The electrode 660 is printed on the first main surface 640*a* in a manner in which the communication hole 681 is annularly surrounded in the circumferential direction on a communication hole 681 side of the annular portion 680. Further, a connection electrode 661 extending from a portion of the electrode 660 located on a communication hole 681 side toward the communication hole 681 is printed on the first main surface 640*a*. The sixth extension portion 635 is connected to the connection electrode 661.

In other words, the electrode 660 is printed on the first main surface 640*a* in a manner in which the through hole 641 is annularly surrounded in the circumferential direction on a through hole 641 side of the annular portion 680. Further, the connection electrode 661 extending from a portion of the electrode 660 located on the through hole 641 side toward the through hole 641 is printed on the first main surface 640*a*. The sixth extension portion 635 is connected to the connection electrode 661.

<Voltage Detection>

As described above, as the opposing part 691 rotates, the first sliding portion 696 slides on one of the resistor body pattern 650, the first conductive pattern 611, and the second conductive pattern 621. Further, the second sliding portion 697 slides on the electrode 660 as the opposing part 691 rotates.

The slider 695 can rotate 360° in the circumferential direction as the opposing part 691 rotates. Therefore, the first sliding portion 696 can slide 360° in the circumferential direction on one of the resistor body pattern 650, the first conductive pattern 611, and the second conductive pattern 621. In other words, the first sliding portion 696 is slidable 360° in the circumferential direction on the annular portion 680. Similarly, the second sliding portion 697 is slidable 360° in the circumferential direction on the electrode 660.

In such manner, the voltage applied to the portion of the resistor body pattern 650 between the first tip portion 615 and the slider 695 in a range of 360° along the circumferential direction can be output to the outside via the electrode 660 and the third conductive portion 630. Then, the voltage applied to the portion of the resistor body pattern 650 between the first tip portion 615 and the slider 695 in a range of 360° in the circumferential direction can be detected by the third conductive terminal 632.

Note that the annular portion 680 of the ideal variable resistor 600 is formed to have a uniform thickness along the z direction in the circumferential direction of 360°. However, a material of the first conductive pattern 611 and the second conductive pattern 621 and a material of the resistor body pattern 650 are different. Therefore, the thickness of the annular portion 680 along the z direction may be not uniform. Therefore, grease (not shown) is applied to the first tip portion 615 and the second tip portion 624.

Further, as the slider 695 rotates with the rotation of the opposing part 691, the resistance value of the portion of the resistor body pattern 650 between the first tip portion 615 and the slider 695 changes.

For example, as shown in FIGS. 7 and 8, the slider 695 slides on the first resistor body pattern 651 and the electrode 660 from the first tip portion 615 toward the second tip portion 624, respectively. In such case, the resistance value of the portion of the first resistor body pattern 651 between the first tip portion 615 and the slider 695 becomes large.

Further, the slider 695 slides on the second resistor body pattern 652 and the electrode 660 from the second tip portion 624 toward the first tip portion 615, respectively. In such case, the resistance value of the portion of the second resistor body pattern 652 between the first tip portion 615 and the slider 695 becomes smaller.

Note that when the first sliding portion 696 of the slider 695 is in contact with the first tip portion 615 and the second sliding portion 697 of the slider 695 is in contact with the electrode 660, the voltage output from the third conductive terminal 632 is 0 V. When the first sliding portion 696 of the slider 695 is in contact with the second tip portion 624 and the second sliding portion 697 of the slider 695 is in contact with the electrode 660, the voltage output from the third conductive terminal 632 is 5 V.

Further, the value of the voltage applied to the portion of the first resistor body pattern 651 between the first tip portion 615 and the slider 695 and the value of the voltage applied to the portion of the second resistor body pattern 652 between the second tip portion 624 and the slider 695 becomes the same at a position in the circumferential direction of 360°.

Therefore, by measuring the voltage output from the third conductive terminal 632, how much in the circumferential direction the slider 695 has rotated from the first tip portion 615 toward the first resistor body pattern 651 side or the second resistor body pattern 652 side is detectable. That is by measuring the voltage of the portion of the annular portion 680 between the first tip portion 615 and the slider 695, it is possible to detect how much the slider 695 is rotated in the circumferential direction from the first tip portion 615.

Whether the slider 695 is located on the first resistor body pattern 651 side or the second resistor body pattern 652 side is electrically determined by the above-mentioned electronic device 700. The electronic device 700 can identify and detect which of the first resistor body pattern 651 side and the second resistor body pattern 652 side the slider 695 is rotated in the circumferential direction.

<Electronic Device>

The electronic device 700 includes a rotation instruction part 710, a rotation direction memory part 720, a time counter 730, a voltage detection part 740, a voltage memory part 750, a voltage change detection part 760, and a position determination part 770. In the drawing, the rotation instruction part 710 is referred to as "RIP", the rotation direction memory part 720 is referred to as "RDMP", the time counter 730 is referred to as "TC", the voltage detection part 740 is referred to as "VDP", the voltage memory part 750 is referred to as "VMP", and the voltage change detection part 760 is referred to as "VCDP", and the position determination part 770 is referred to as "PDP".

The rotation instruction part 710 plays a role of rotationally driving the DC motor 510 in response to an operation from an operator. In response to the above operation, the rotation instruction part 710 instructs the DC motor 510 to be rotationally driven. Along with such instruction, the rotating part 690 rotates in the circumferential direction to either the first resistor body pattern 651 side or the second resistor body pattern 652 side.

The rotation direction memory part 720 plays a role of storing a rotation direction of the rotating part 690 in the circumferential direction that rotates in response to the instruction of the rotation instruction part 710.

The time counter 730 is a device that counts a predetermined time as one cycle. The predetermined time is, for example, 20 ms. The predetermined time is not limited to 20 ms. The time counter 730 starts the first count at startup. The startup time is a start time of rotation. The time counter 730 may start the first count after a predetermined time from the startup. In such case, the voltage memory part 750 may store a voltage at the start of rotation before the first count.

The voltage detection part 740 plays a role of detecting the voltage applied to the portion of the resistor body pattern 650 between the slider 695 and the first tip portion 615. For each count of the time counter 730, the voltage of the portion of the resistor body pattern 650 between the slider 695 and the first tip portion 615 is detected by the voltage detection part 740.

The voltage memory part 750 plays a role of storing the voltage detected by the voltage detection part 740. For each count of the time counter 730, the value of the voltage applied to the portion of the resistor body pattern 650 between the slider 695 and the first tip portion 615 is stored in the voltage memory part 750.

Note that the value of the voltage applied to the portion of the resistor body pattern 650 between the slider 695 and the first tip portion 615 at the latest count does not have to be stored in the voltage memory part 750. The value of the voltage applied to the portion of the resistor body pattern 650 between the slider 695 and the first tip portion 615 at the latest count may be output to the voltage detection part 740.

The voltage change detection part 760 has a role of comparing the voltage value stored in the voltage memory part 750 with the voltage value detected at the latest count and detecting the amount of change.

The output result of the rotation direction memory part 720 and the output result of the voltage change detection part 760 are taken into the position determination part 770. The position determination part 770 can identify which of the first resistor body pattern 651 side and the second resistor body pattern 652 side the slider 695 is rotated, and can detect how much the slider 695 has rotated in the circumferential direction.

<How to Use the Electronic Device in Vehicle Air Conditioners>

The case where the electronic device 700 is used for or in the vehicle air conditioner 1000 will be described below.

As described above, the rotating part 690 is connected to the door device of the vehicle air conditioner 1000 via a link (not shown) or the like. Therefore, when the rotating part 690 rotates, the outlet mode can be switched to any of defroster mode, face mode, foot mode, bi-level (B/L) mode, and foot defroster (F/D) mode.

Along with such switching, the variable resistor 600 outputs a voltage corresponding to each of the defroster mode, face mode, foot mode, bi-level (B/L) mode, and foot defroster (F/D) mode. V1 is output in the defroster mode and the face mode. V2 is output in the bi-level (B/L) mode and the foot defroster (F/D) mode. In foot mode, Vz is output.

Figure 15:
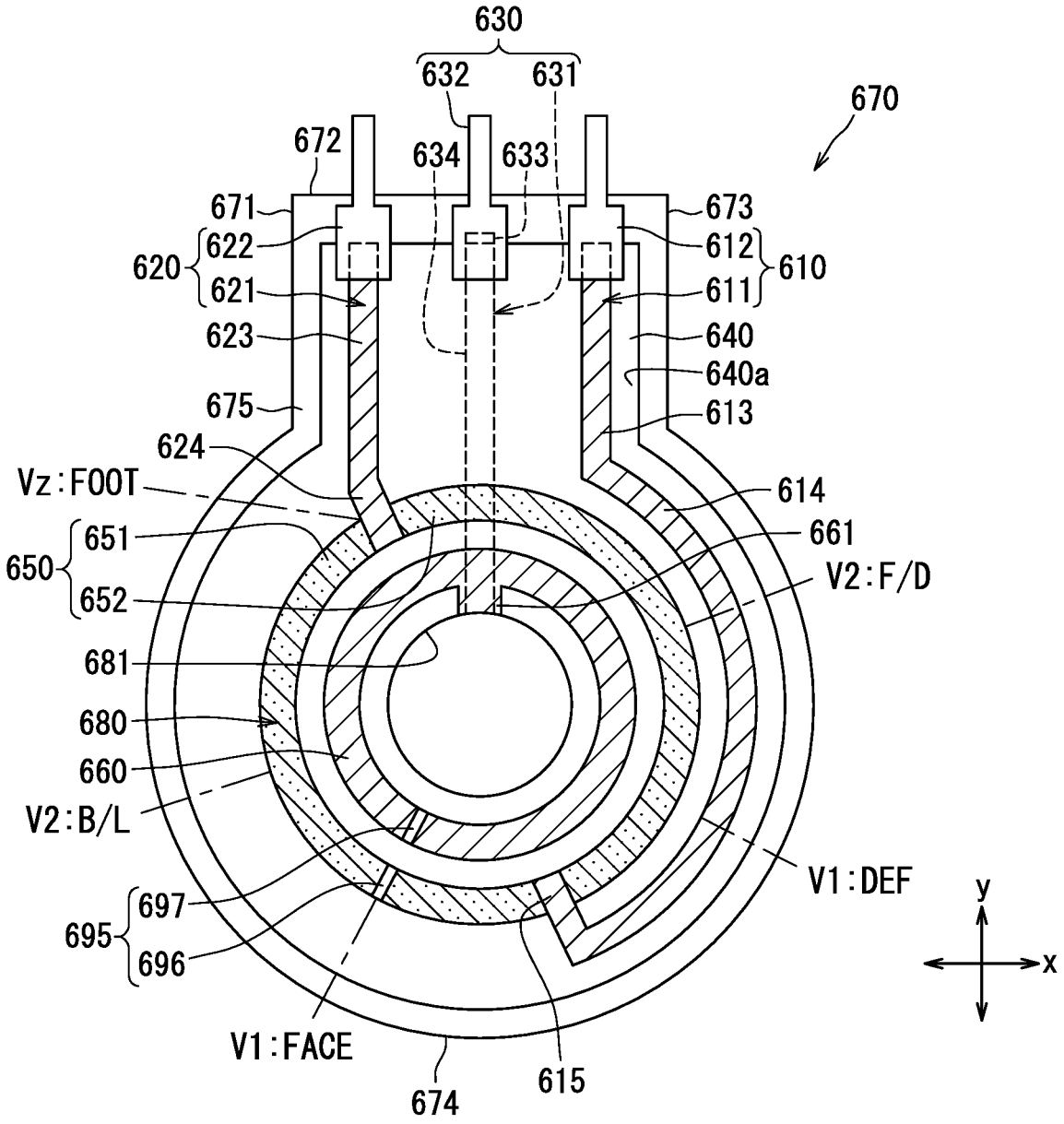
FIG. 15 is a top view for explaining a relationship between an outlet mode and a rotation position.
Figure 16:
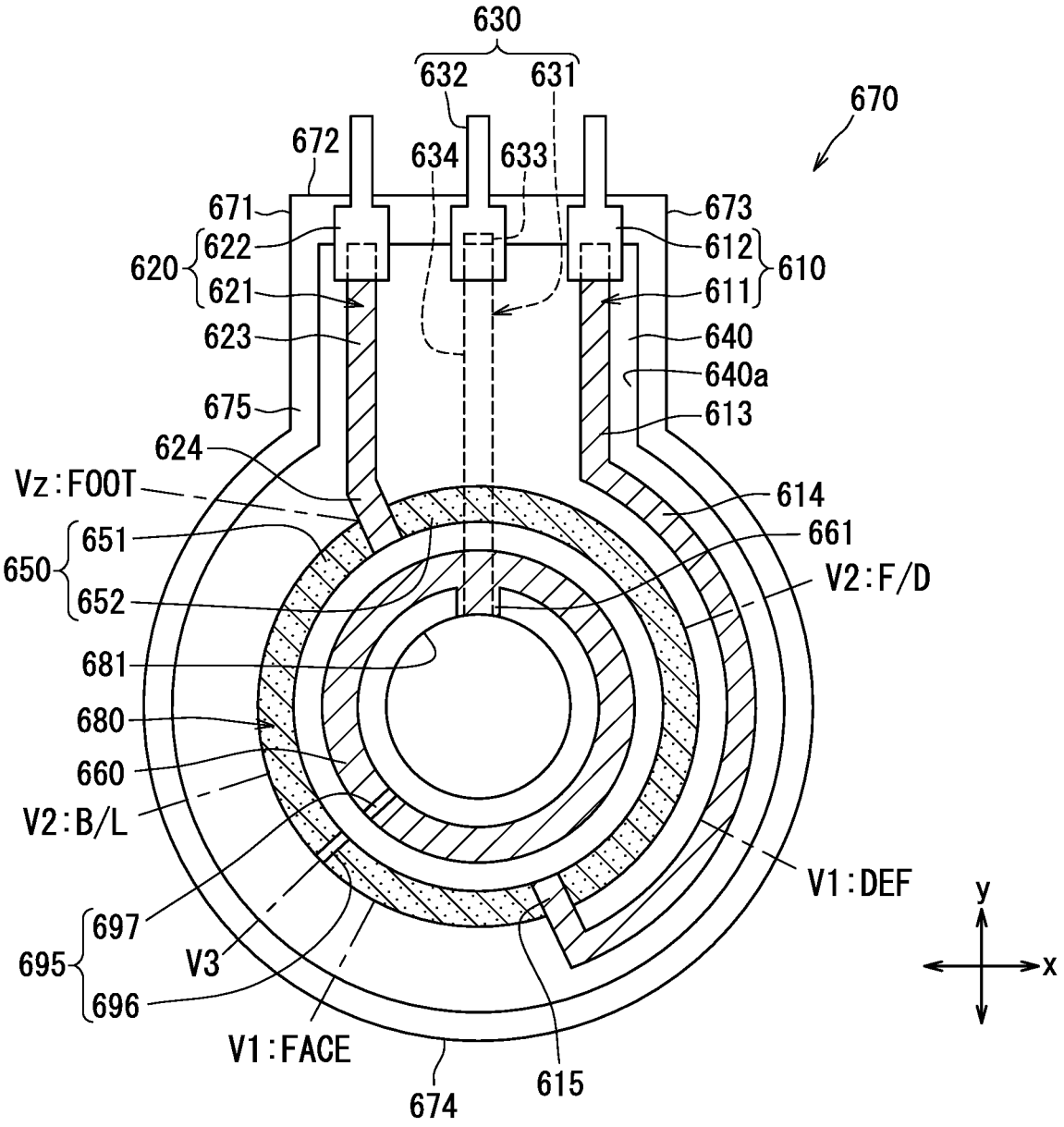
FIG. 16 is another top view for explaining a relationship between the outlet mode and the rotation position.

At such timing, as shown in FIGS. 15 and 16, the slider 695 is moved to a position corresponding to the defroster mode, face mode, foot mode, bi-level (B/L) mode, or foot defroster (F/D) mode in the circumferential direction. Note that FIGS. 15 and 16 show a form in which the slider 695 is projected onto the annular portion 680 and the electrode 660 in order to explain the sliding form of the slider 695, on the annular portion 680 and the electrode 660.

When the electronic device 700 is activated in response to an operation from the operator, the time counter 730 starts counting, and the voltage detection part 740 detects the voltage applied to the portion of the resistor body pattern 650 between the slider 695 and the first tip portion 615. Then, the voltage at the start of rotation is stored by the voltage memory part 750.

Figure 17:
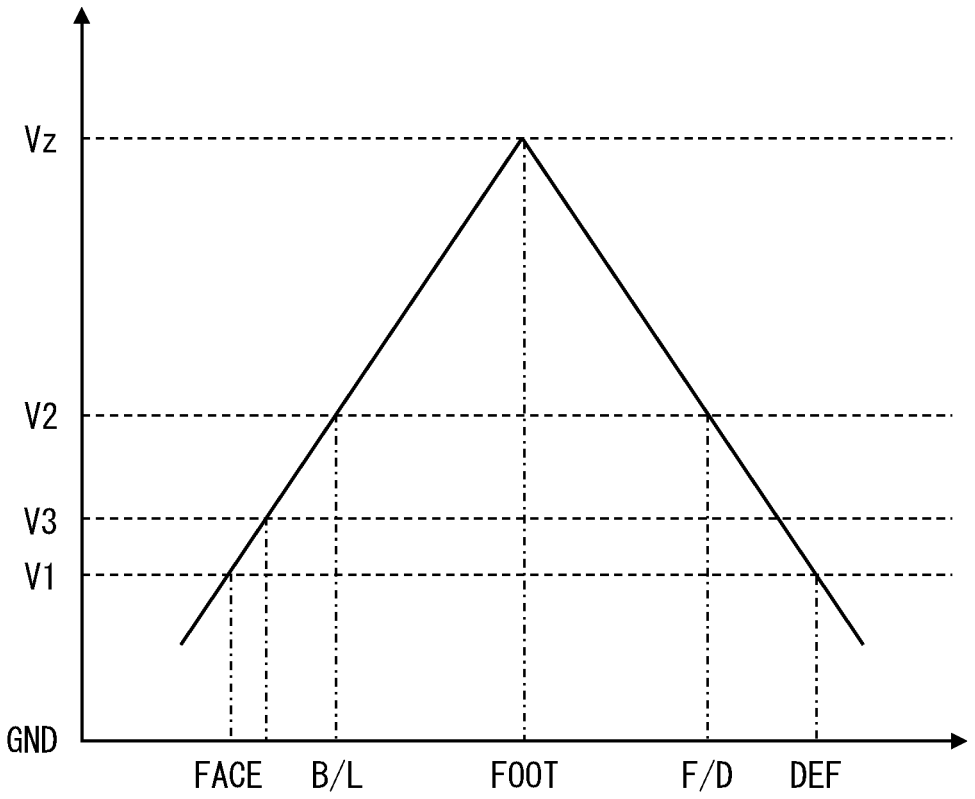
FIG. 17 is a graph illustrating a relationship between the outlet modes and voltages.

As shown in FIGS. 15 and 17, when the voltage at the start of rotation is, for example, V1, it is assumed that the position of the slider 695 is either in the face mode or in the foot defroster (F/D) mode. However, the electronic device 700 cannot recognize whether the position of the slider 695 at the start of rotation is in the face mode position or the foot defroster (F/D) mode position.

In order to solve such a problem, the rotation instruction part 710 first rotates the rotating part 690 to either the first resistor body pattern 651 side or the second resistor body pattern 652 side in the circumferential direction. For example, if the rotating part 690 rotates clockwise, the rotation direction is stored by the rotation direction memory part 720. Then, the voltage applied to the portion of the resistor body pattern 650 between the slider 695 and the first tip portion 615 is detected after a predetermined time by the voltage detection part 740. Further, the voltage change detection part 760 compares the voltage value at the start of rotation with the voltage value after a predetermined time, and the amount of change is detected.

As shown in FIGS. 16 and 17, for example, when the voltage after a predetermined time from the start of rotation is V3, the voltage change detection part 760 retains, as information, that a voltage after a predetermined time from the start of rotation is higher than the voltage at the start of rotation. Then, the output result of the voltage change detection part 760 and the output result of the rotation direction memory part 720 are taken into the position determination part 770.

Therefore, the position determination part 770 can identify that the position of the slider 695 at the start of rotation is in the face mode position. When a target outlet mode is set to the foot defroster (F/D) mode at a start time of the electronic device 700, the slider 695 is kept rotated clockwise (i) from a rotated position by an amount of predetermined time from the face mode position (ii) to(ward) the foot defroster (F/D) mode position. Then, at a timing of when the slider 695 reaches the position of the foot defroster (F/D) mode, the rotation of the opposing part 691 is stopped.

<Operation and Effects>

As described above, the third conductive pattern 631 has the fourth extension portion 633, the fifth extension portion 634, and the sixth extension portion 635. The fourth extension portion 633 extends on the connecting surface 640*d* from the first main surface 640*a* toward the second main surface 640*b*. The fifth extension portion 634 extends on the second main surface 640*b* from a tip of the fourth extension portion 633 toward the through hole 641. The sixth extension portion 635 extends on the partition wall surface 640*c* from the tip of the fifth extension portion 634 toward the first main surface 640*a*. The sixth extension portion 635 is connected to the connection electrode 661.

According to such configuration, it is not necessary to provide a gap for passing the third conductive pattern 631 at a position between the first tip portion 615 and the second tip portion 624 in the circumferential direction. As a result, the annular portion 680 extending continuously in the circumferential direction can be formed on the first main surface 640*a*.

Therefore, the first sliding portion 696 of the slider 695 is always slid on the annular portion 680 at the same radial position regardless of the rotation position of the opposing part 691. Regardless of the rotation position of the opposing part 691, a voltage corresponding to the resistance value of the portion of the resistor body pattern 650 between the first tip portion 615 and the slider 695 is detected at the third conductive terminal 632.

Thus, there is no need to provide a plurality of sliders 695 on the opposing part 691. Further, the number of components of the variable resistor 600 is reducible.

As described above, the electronic device 700 includes a rotation instruction part 710, a rotation direction memory part 720, a time counter 730, a voltage detection part 740, a voltage memory part 750, a voltage change detection part 760, and a position determination part 770.

The rotation instruction part 710 instructs the DC motor 510 to be rotationally driven. The rotation direction memory part 720 stores the rotation direction of the rotating part 690 in the circumferential direction. The time counter 730 counts a predetermined time as one cycle. For each count of the time counter 730, the voltage of the portion of the resistor body pattern 650 between the slider 695 and the first tip portion 615 is detected by the voltage detection part 740. For each count of the time counter 730, the value of the voltage applied to the portion of the resistor body pattern 650 between the slider 695 and the first tip portion 615 is stored in the voltage memory part 750.

The value of the voltage detected at the start of rotation by the voltage change detection part 760 is compared with the value of the voltage detected at the latest count. The amount of change is detected by the voltage change detection part 760. The output result of the voltage change detection part 760 and the output result of the rotation direction memory part 720 are taken into the position determination part 770. Therefore, the position determination part 770 can identify how much the slider 695 has rotated in the circumferential direction to either the first resistor body pattern 651 side or the second resistor body pattern 652 side.

Figure 9:
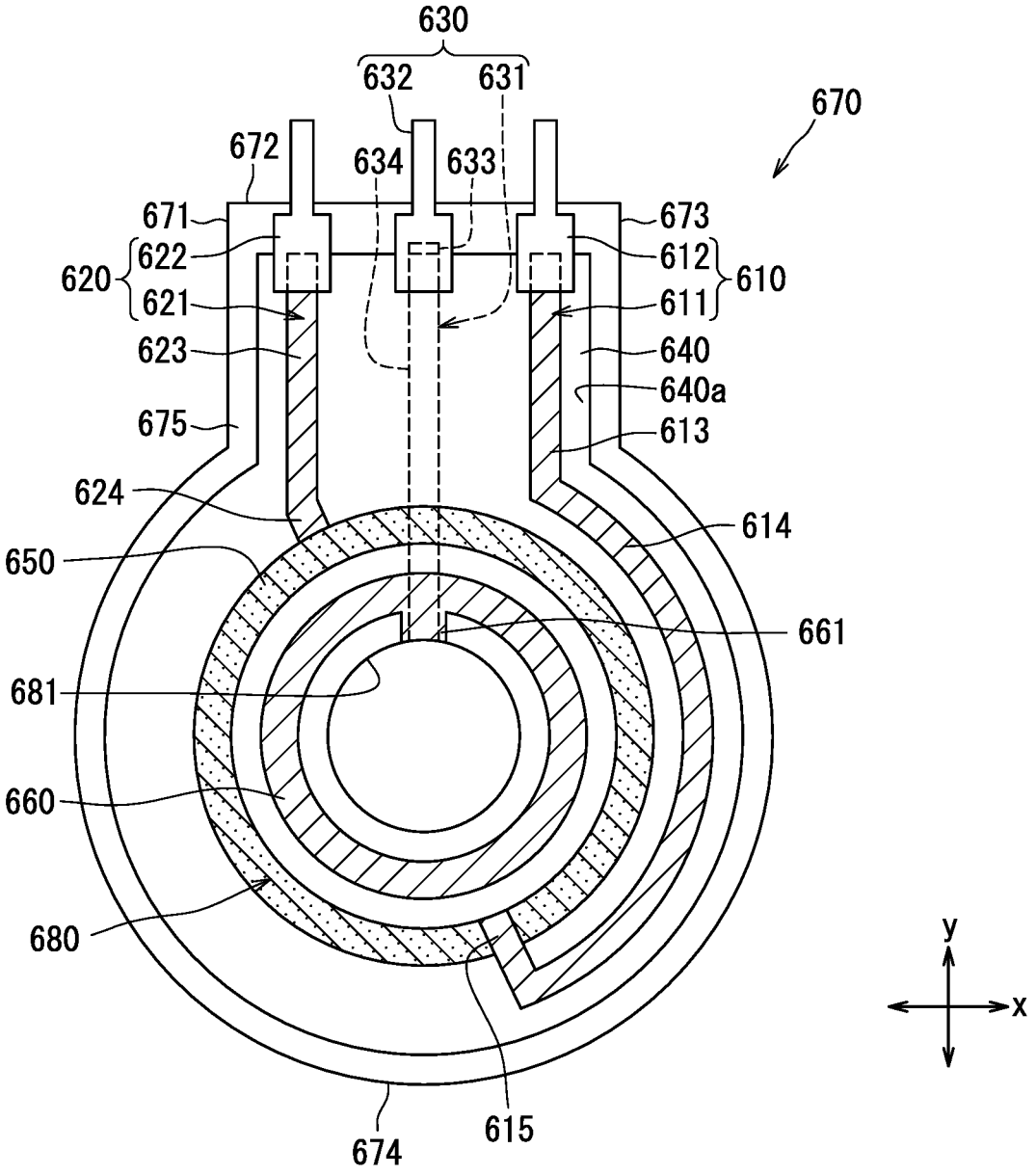
FIG. 9 is a top view illustrating a modification of a conductive pattern.

First Modification, FIG. 9

In the present embodiment, the first resistor body pattern 651 is connected to one end in the circumferential direction of the first tip portion 615 and one end in the circumferential direction of the second tip portion 624, respectively. The second resistor body pattern 652 is connected to the other end in the circumferential direction of the first tip portion 615 and the other end in the circumferential direction of the second tip portion 624, respectively.

However, as shown in FIG. 9, the resistor body pattern 650 may be connected to one end and the other end of the first tip portion 615 in the circumferential direction. In such case, the second tip portion 624 may be connected to a side portion of the resistor body pattern 650, which is radially positioned away from (i.e., orthogonally away relative to the circumferential direction) the communication hole 681 and is separated from the communication hole 681 in the orthogonal direction. According to such configuration, the resistor body pattern 650 can be printed once (i.e., as one pattern) in the circumferential direction. Workability is expected to improve.

Figure 10:
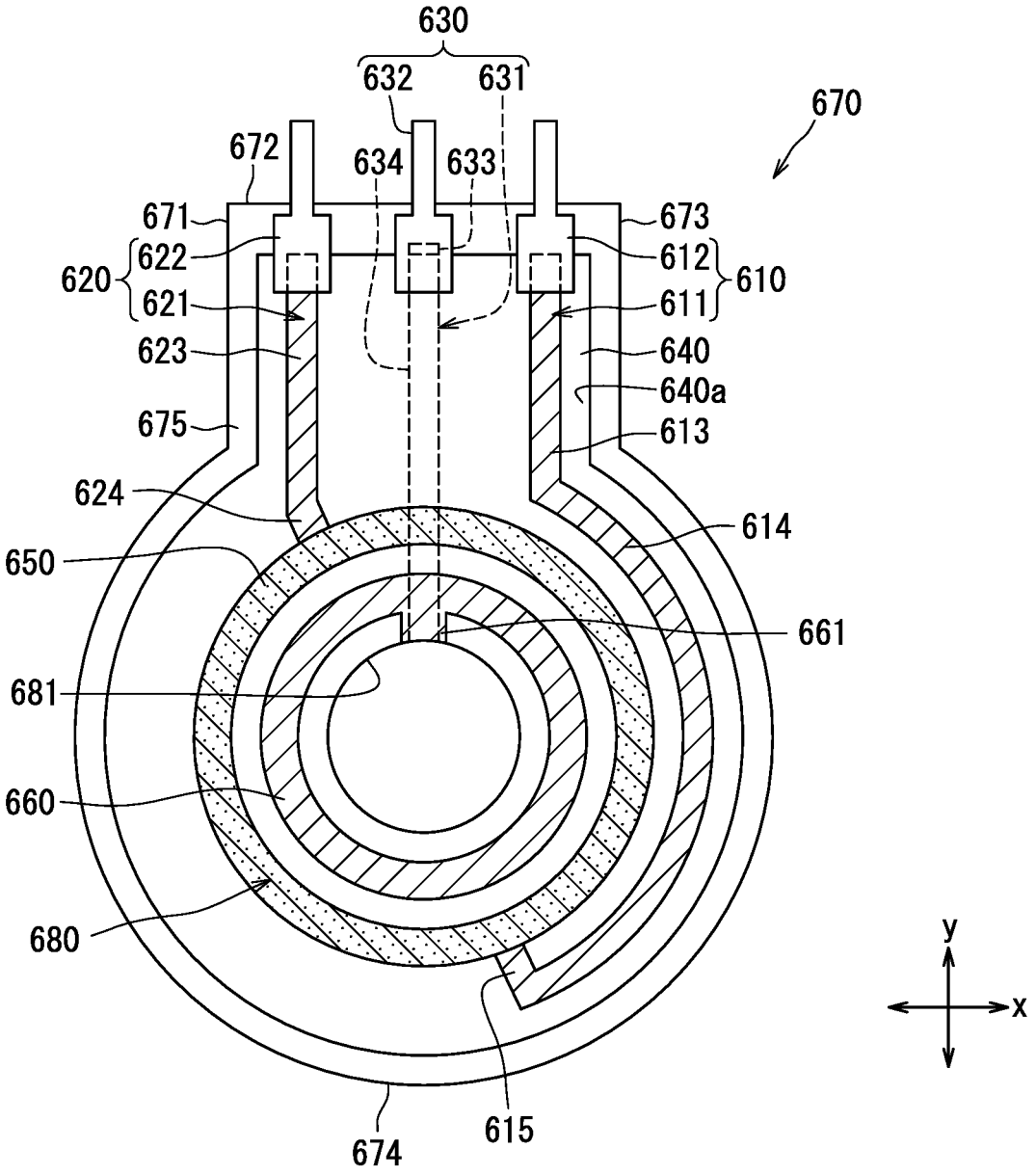
FIG. 10 is another top view illustrating a modification of the conductive pattern.

Second Modification, FIG. 10

Further, as shown in FIG. 10, the annular portion 680 may be formed only by the resistor body pattern 650. In such case, the first tip portion 615 and the second tip portion 624 may be respectively connected to a side portion of the resistor body pattern 650, which is radially positioned away from (i.e., orthogonally away relative to the circumferential direction [or a tangent of a circle of electrode 660] and from) the communication hole 681 and is separated from the communication hole 681 in the orthogonal direction. According to such configuration, the slider 695 is easily slidable on the annular portion 680 along the circumferential direction.

Figure 11:
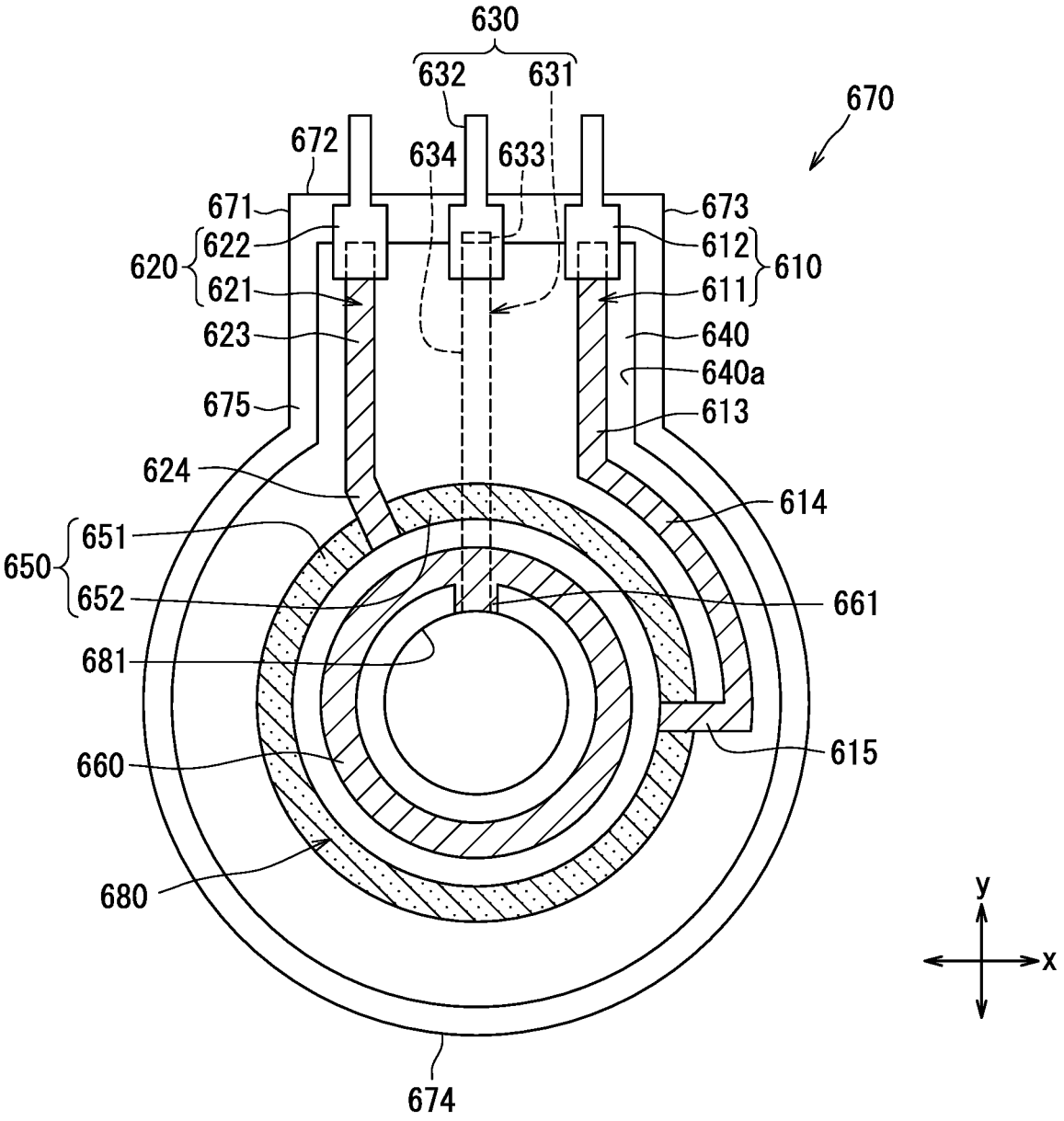
FIG. 11 is yet another top view illustrating a modification of the conductive pattern.

Third Modification, FIG. 11

As shown in FIG. 11, the circumferential separation distance between the first tip portion 615 and the second tip portion 624 may be different between the first resistor body pattern 651 and the second resistor body pattern 652 (i.e., asymmetric arrangement).

For example, when the circumferential separation distance between the first tip portion 615 and the second tip portion 624 is longer on a first resistor body pattern 651 side than on a second resistor body pattern 652 side, the amount of change in the resistance value per unit length is smaller on the first resistor body pattern 651 side. Therefore, the voltage detection accuracy is improvable on a first resistor body pattern 651 side.

Figure 12:
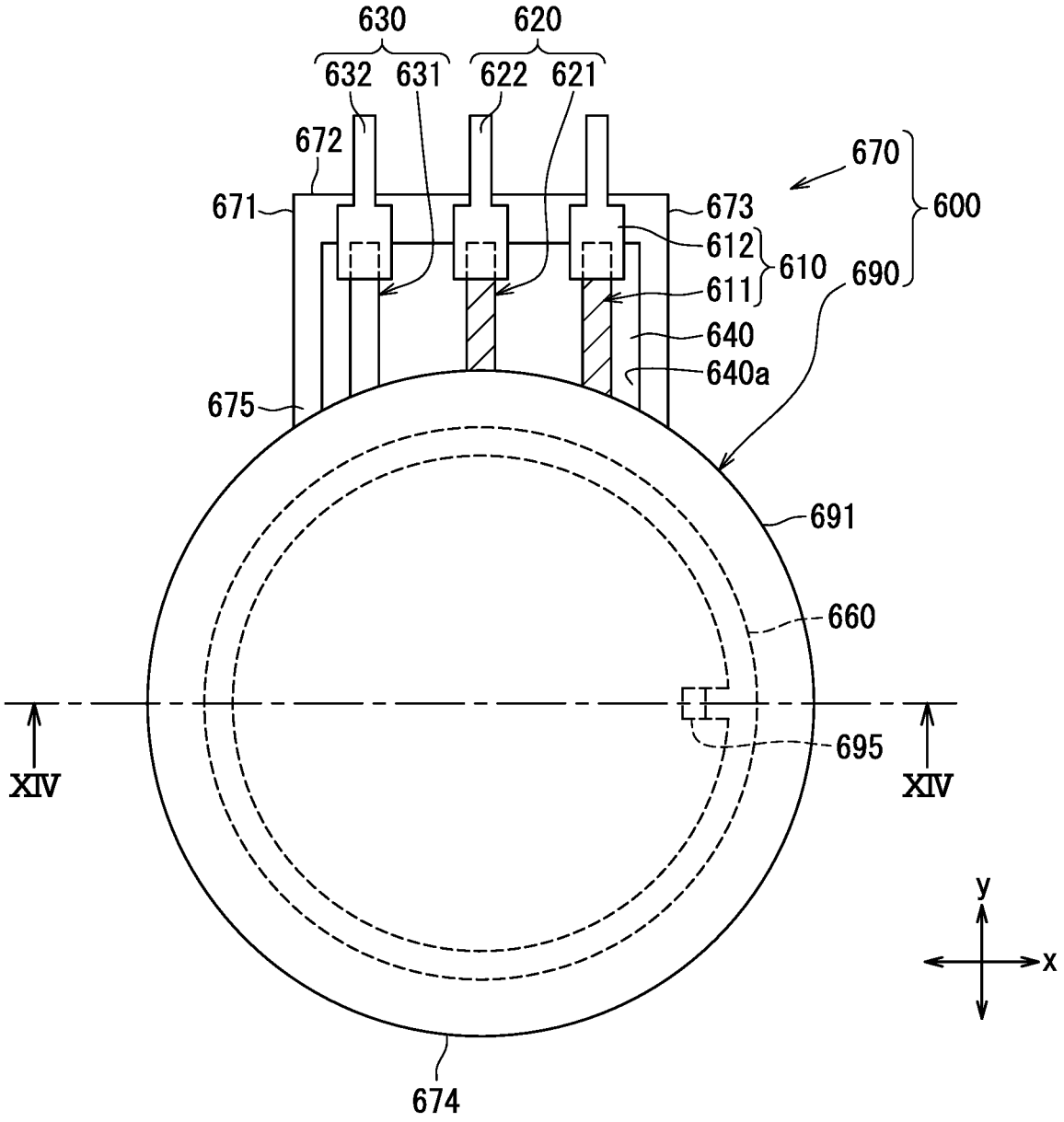
FIG. 12 is a top view illustrating a modification of the variable resistor.
Figure 13:
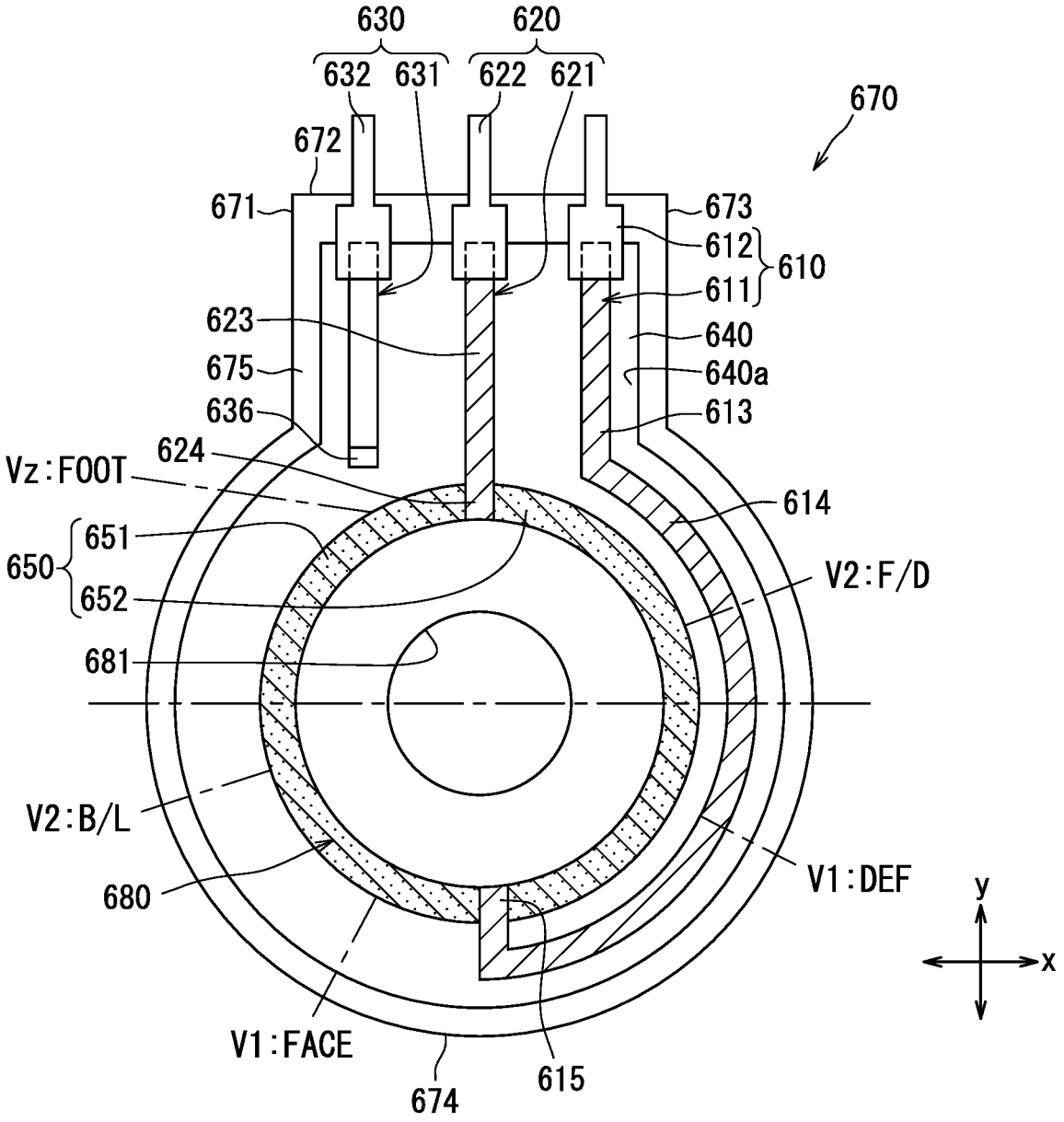
FIG. 13 is a top view showing a modification of the variable resistor shown in FIG. 12 excluding the rotating part.
Figure 14:
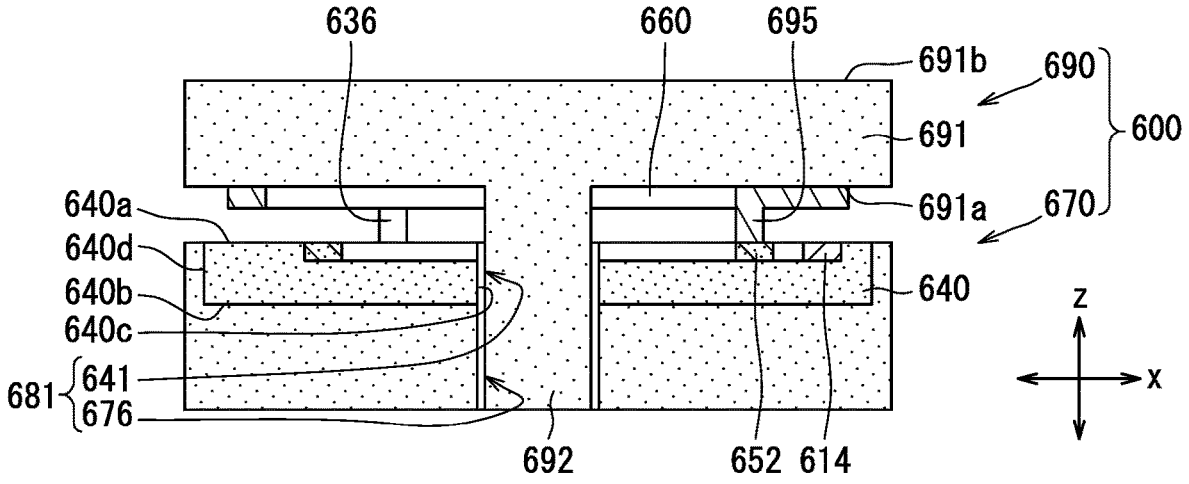
FIG. 14 is a cross-sectional view of a modification of the variable resistor along a XIV-XIV line shown in FIG. 12.

Fourth Modification, FIGS. 12-14

As shown in FIGS. 12 to 14, the electrode 660 having an annular shape in the circumferential direction may be provided on the opposing surface 691*a* of the opposing part 691. In such case, the electrode 660 is formed of a conductive member. The slider 695 is connected to the electrode 660. The slider 695 extends in the z direction from the opposing surface 691*a* toward the first main surface 640*a*. Note that a cross-sectional line XIV-XIV shown in FIG. 12 also appears in FIG. 13 (without numerals) to indicate to which position of the main body 670 the cross-sectional line shown in FIG. 12 corresponds.

The substrate 640 is provided with the first conductive pattern 611, the second conductive pattern 621, the third conductive pattern 631, and the resistor body pattern 650. The annular portion 680 is formed by the first tip portion 615, the second tip portion 624, and the resistor body pattern 650. The first extension portion 613 and the second extension portion 614 included in the first conductive pattern 611 are printed at positions farther away from the communication hole 681 than the resistor body pattern 650 in the orthogonal direction orthogonal to the circumferential direction.

The annular portion 680 is located on a communication hole 681 side in the orthogonal direction orthogonal to the circumferential direction than the electrode 660. The first conductive pattern 611 is printed on the substrate 640 to face the electrode 660 provided on the opposing part 691 in the Z direction. In such manner, the physique/volume of the variable resistor 600 in the X direction and the Y direction may be reduced.

Further, the first conductive terminal 612, the second conductive terminal 622, and the third conductive terminal 632 are arranged in this written order from the third wall portion 673 toward the first wall portion 671 so as to be separated from each other in the X direction. The first conductive terminal 612 is connected to the first conductive pattern 611. The second conductive terminal 622 is connected to the second conductive pattern 621. The third conductive terminal 632 is connected to the third conductive pattern 631.

Further, a connection terminal 636 extending from the substrate 640 toward the opposing surface 691*a* is connected to the third conductive pattern 631. The connection terminal 636 is slidable on the electrode 660 provided on the opposing part 691. In such manner, the voltage applied to the portion of the resistor body pattern 650 between the first tip portion 615 and the slider 695 is output to the outside via the electrode 660, the connection terminal 636, the third conductive pattern 631, and the third conductive terminal 632.

Fifth Modification, FIGS. 17-20

In the present embodiment, the opposing part 691 included in the rotating part 690 can rotate 360° in the circumferential direction in conjunction with the operation shaft. However, for example, the rotation of the opposing part 691 in the circumferential direction may be mechanically restricted at an abutting position where the face outlet 140 is fully closed. For example, the rotation of the opposing part 691 in the circumferential direction may be mechanically restricted by forming a protrusion or the like on the opposing part 691 and abutting it against a component of the variable resistor 600 positioned closed to the protrusion.

Figure 22:
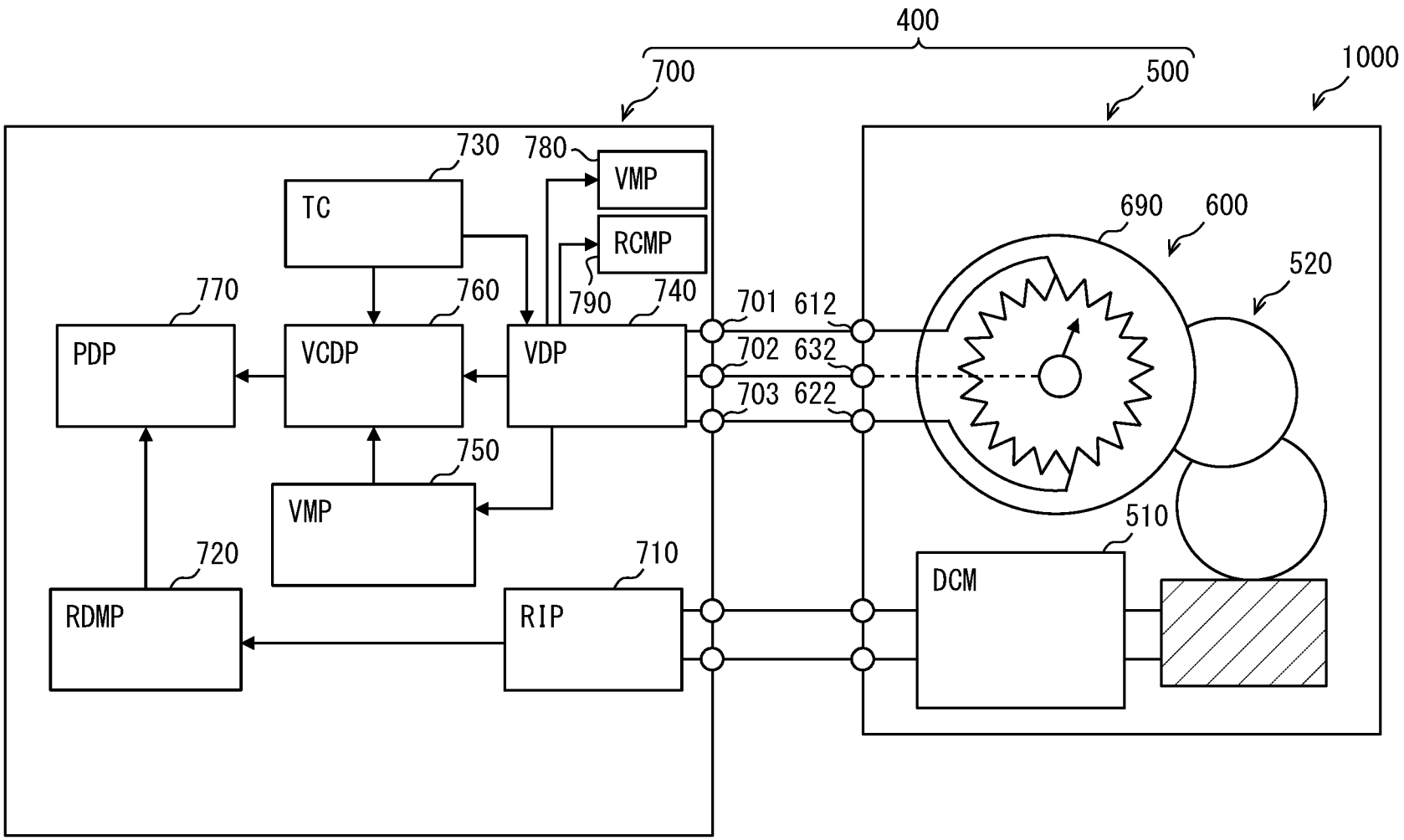
FIG. 22 is a schematic diagram of the control system for explaining a voltage storage unit and a rotation number storage unit.

Further, the electronic device 700 has a voltage memory part 780, which stores the voltage applied to the portion of the resistor body pattern 650 between the slider 695 and the first tip portion 615 and detected at the position where the rotation of the opposing part 691 in the circumferential direction is mechanically restricted. Note that, in FIG. 22, the voltage memory part 780 is referred to as "VMP."

In such manner, the voltage applied to the portion of the resistor body pattern 650 between the slider 695 and the first tip portion 615 is accurately definable at the position where the rotation of the opposing part 691 in the circumferential direction is mechanically restricted. Thus, a position where the face outlet 140 is fully closed is accurately definable in the opposing part 691.

Note that the voltage applied to the portion of the resistor body pattern 650 between the slider 695 and the first tip portion 615 and defined at the position where the face outlet 140 is fully closed is set to a value higher than 0 V. In other words, the voltage detected from the third conductive terminal 632 is set to a value higher than 0 V.

Similarly, the rotation of the opposing part 691 in the circumferential direction may be mechanically restricted at an abutting position where the defroster outlet 130 is fully opened.

In such manner, the voltage applied to the portion of the resistor body pattern 650 between the slider 695 and the first tip portion 615 is accurately definable. Thus, the position at which the defroster outlet 130 is fully opened is accurately definable in the opposing part 691.

Note that the voltage applied to the portion of the resistor body pattern 650 between the slider 695 and the first tip portion 615 and defined at the position where the defroster outlet 130 is fully opened is set to a value higher than 0 V. In other words, the voltage detected from the third conductive terminal 632 is set to a value higher than 0 V. Therefore, the movable range of the opposing part 691 in the circumferential direction may be intentionally made smaller than 360°.

As shown in FIG. 17, the voltage applied to the portion of the resistor body pattern 650 between the slider 695 and the first tip portion 615 is higher than 0 V.

Figure 18:
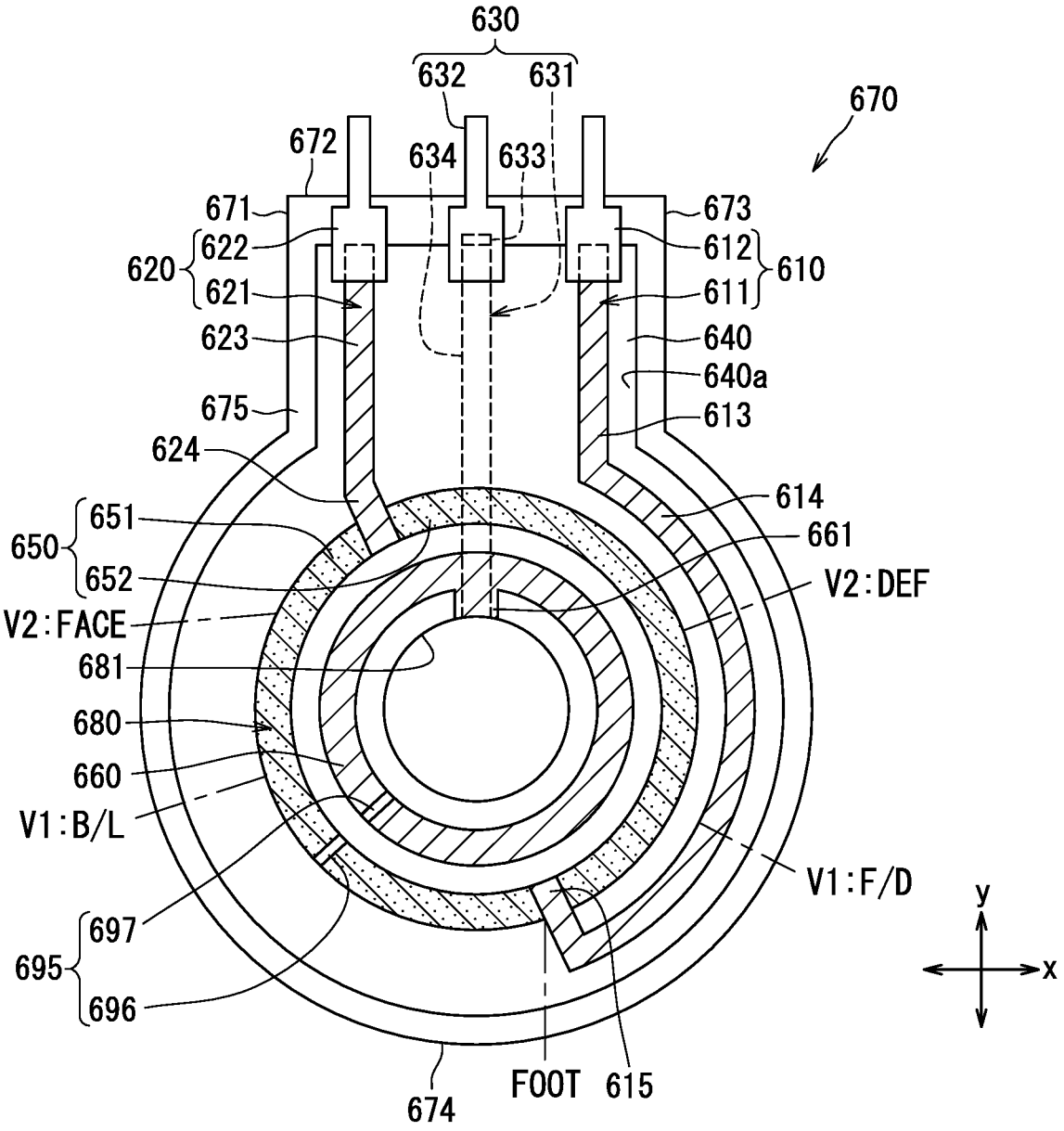
FIG. 18 is a top view for explaining a relationship between the outlet mode and the rotation position.
Figure 19:
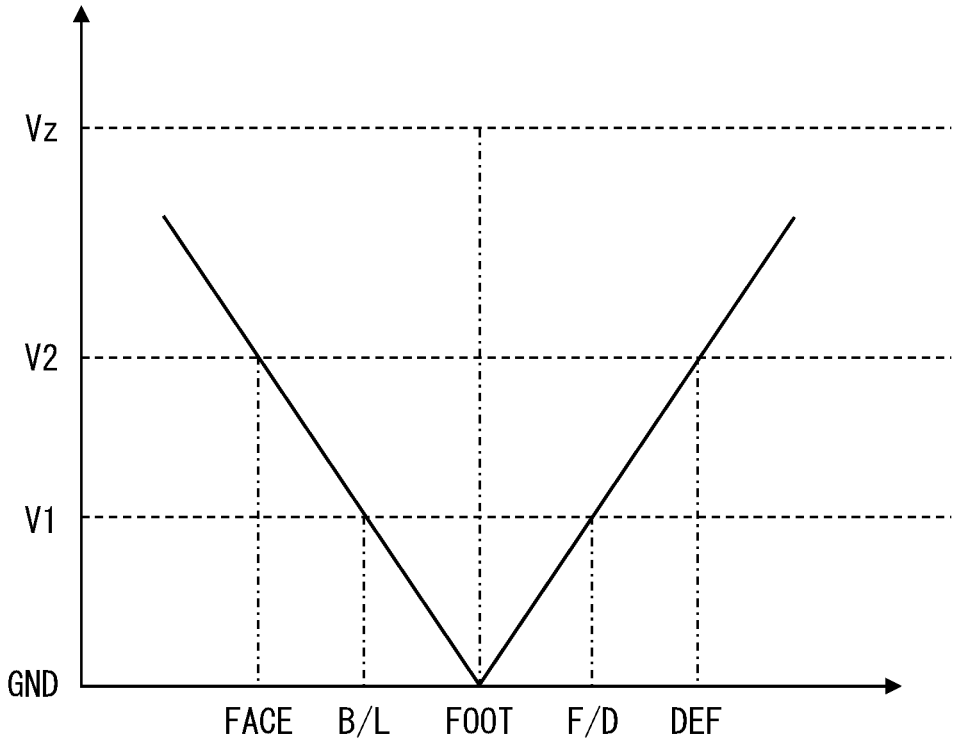
FIG. 19 is a graph illustrating a relationship between the outlet modes and the voltages.

Further, as shown in FIG. 18, the position of the outlet mode (i.e., positioning of the outlet mouth) may be different from the configurations shown so far in the above. This configuration is referred to as an open detection configuration. In the open detection configuration, V2 is output in the defroster mode and the face mode as shown in FIG. 19. V1 is output in the bi-level (B/L) mode and the foot defroster (F/D) mode. In the foot mode, 0 V is output. The voltage applied to the portion of the resistor body pattern 650 between the slider 695 and the first tip portion 615 is lower than 5 V. Note that FIG. 18 shows a configuration in which the slider 695 is projected onto the annular portion 680 and the electrode 660, for the explanation of the sliding form of the slider 695 on the annular portion 680 and the electrode 660.

Figure 20:
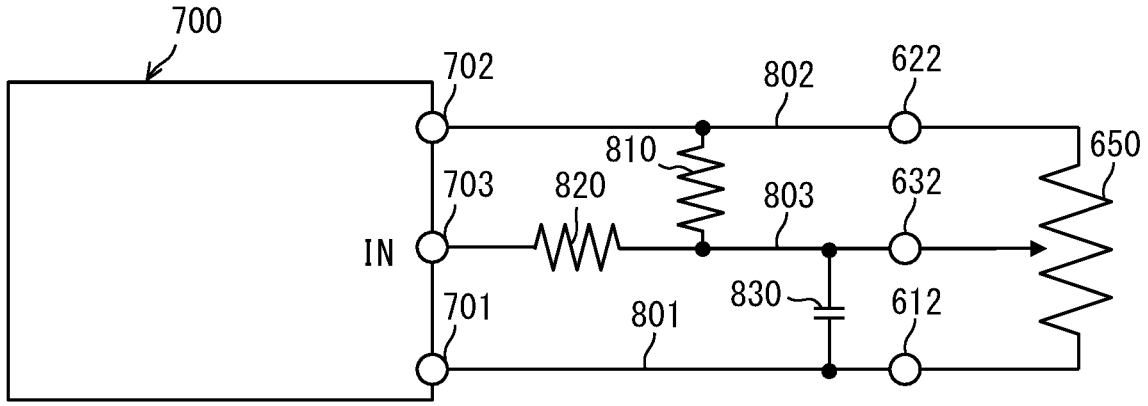
FIG. 20 is an electrical circuit diagram between an electronic control device and an actuator.

Next, the electrical connection between the variable resistor 600 and the electronic device 700 is described. As shown in FIG. 20, the first conductive terminal 612 is connected to a first control terminal 701 of the electronic device 700 via a first conductive portion 801. The second conductive terminal 622 is connected to a second control terminal 702 of the electronic device 700 via a second conductive portion 802. The third conductive terminal 632 is connected to a third control terminal 703 of the electronic device 700 via a third conductive portion 803. A voltage of, for example, 5 V is applied between the first conductive terminal 612 and the second conductive terminal 622.

A capacitor 830 for stabilization is inserted between the first conductive portion 801 and the third conductive portion 803. A first resistance portion 810 for stabilization is inserted between the second conductive portion 802 and the third conductive portion 803. A second resistance portion 820 for limiting electric current is inserted between the third conductive terminal 632 and the third control terminal 703. The capacitor 830 connects or bridges the first conductive portion 801 and the third conductive portion 803 at a position on a conductive terminal 632 side of the first resistance portion 810. The first resistance portion 810 connects or bridges the second conductive portion 802 and the third conductive portion 803 at a position on a conductive terminal 632 side of the second resistance portion 820.

Therefore, an electric current flows from the third conductive terminal 632 to the third control terminal 703 through the second resistance portion 820. The voltage between the first conductive terminal 612 and the third conductive terminal 632 can be detected based on the electric current flowing through the third control terminal 703. In other words, the voltage at the portion of the resistor body pattern 650 between the first tip portion 615 and the slider 695 is detectable based on the electric current flowing through the third control terminal 703.

However, when the slider 695 is damaged due to wear or the like, the electric current flowing through the second conductive terminal 622 flows respectively through the first resistance portion 810 and the second resistance portion 820 to the third control terminal 703. Therefore, the voltage of the portion of the resistor body pattern 650 between the first tip portion 615 and the second tip portion 624 is detectable by the third control terminal 703. In other words, 5 V is always detected from the third control terminal 703. As described above, in the open detection configuration, the voltage applied to the portion of the resistor body pattern 650 between the slider 695 and the first tip portion 615 is lower than 5 V. Therefore, when the detected voltage is 5 V, it indicates that the slider 695 is damaged due to wear or the like (i.e., wear of the slider 695 is recognizable in such manner).

Figure 21:
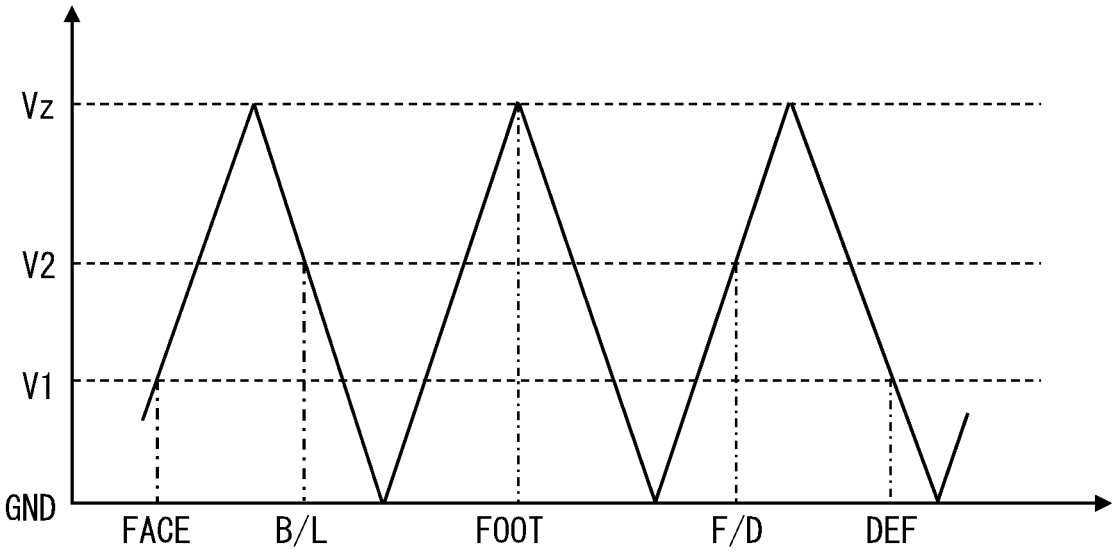
FIG. 21 is a graph illustrating a relationship between the outlet modes and the voltages during continuous rotation.

Sixth Modification, FIG. 21

As shown in FIG. 21, at an abutting position where the face outlet 140 is fully closed, the rotation of the opposing part 691 in the circumferential direction is mechanically restricted, and the rotation of the rotating part 690 by 360° or more in the circumferential direction may be made possible. Further, the electronic device 700 includes a rotation number storage unit 790 that stores the rotation number from a position set so that the rotation of the opposing part 691 is mechanically stopped. In such manner, a state of the outlet mode can be grasped from output information of the rotation number storage unit 790. Note that, in FIG. 22, the rotation number storage unit 790 is referred to as "RCMP."

Further, when the opposing part 691 is configured to be continuously rotatable in the circumferential direction within a predetermined time, an error of the rotation position with respect to an error of the detected voltage is made smaller. Therefore, the rotation position of the slider 695 according to the voltage detected at the third conductive terminal 632 is accurately determinable. Thus, it is possible to accurately grasp the state of the outlet mode.

What is claimed is:

1. A variable resistor comprising:

a main body and a rotating part, wherein the main body includes:

(i) a substrate including: a first main surface facing vertically upward, a second main surface facing vertically downward, a partition wall surface, and a connecting surface;

(ii) a through hole vertically penetrating the first main surface and the second main surface, and at least partially defined by the partition wall surface;

(iii) a first conductive portion and a second conductive portion provided on the first main surface, arranged apart from each other, and configured to receive a predetermined voltage between the first conductive portion and the second conductive portion;

(iv) a resistor body provided on the first main surface and electrically connected to the first conductive portion and to the second conductive portion, wherein the resistor body forms at least a majority of an annular portion;

(v) an electrode provided on the first main surface, and located radially interior to the resistor body with respect to a vertical rotation axis of the rotating part; and (vi) a third conductive portion partially located on the second main surface, partially located on the partition wall surface, and electrically connected to the electrode, and the rotating part includes:

(i) an opposing part that: is substantially disc shaped, includes an opposing surface facing the first main surface of the substrate, and is configured to rotate about the vertical rotation axis; and (ii) a slider located on the opposing surface and including: a first sliding portion and a second sliding portion, wherein the first sliding portion is configured to electrically contact and to rotationally slide on the annular portion as the rotating part rotates, wherein the second sliding portion is configured to electrically contact and to rotationally slide on the electrode as the rotating part rotates, wherein the annular portion forms a full circle on the first main surface, and has a larger diameter than the through hole, and wherein the annular portion is formed by the resistor body alone, or is formed by a combination of the resistor body and at a part of at least one of the first conductive portion and the second conductive portion.

2. A variable resistor comprising:

a main body and a rotating part that are vertically separated and face each other, wherein the main body includes:

a substrate having a first main surface vertically separated from a second main surface provided on a back side thereof, and having a through hole vertically penetrating the first main surface and the second main surface;

a first conductive portion and a second conductive portion provided on the first main surface, arranged apart from each other in a circumferential direction relative to a vertical rotation axis, and to which a predetermined voltage is applied;

a resistor body provided on the first main surface and connected to each of the first conductive portion and the second conductive portion; and a third conductive portion provided on the first main surface and provided with a connection terminal extending away from the first main surface, and the rotating part includes:

an opposing part including an opposing surface that faces the first main surface and rotates around the vertical rotation axis, an electrode formed in an annular shape along the circumference direction and configured to slide on the connection terminal as the opposing part rotates, which is provided on the opposing surface on a first main surface side of the opposing part, and located on one side away from the resistor body than the through hole in the orthogonal direction orthogonal to the circumferential direction; and a slider connected to the electrode and configured to slide on an annular portion that extends continuously in the circumferential direction around the through hole and formed by (i) the resistor body alone or (ii) the resistor body and a portion of at least one of the first conductive portion and the second conductive portion.

3. The variable resistor of claim 1, wherein the resistor body includes a first resistor body and a second resistor body, the first conductive portion is connected to each of the first resistor body and the second resistor body in the circumferential direction, the second conductive portion is connected to each of the first resistor body and the second resistor body in the circumferential direction, and the annular portion is formed by the first conductive portion, the second conductive portion, the first resistor body, and the second resistor body.

4. The variable resistor of claim 1, wherein only one of the first conductive portion and the second conductive portion is connected to the resistor body in the circumferential direction, a remaining of the first conductive portion and the second conductive portions is connected to the resistor body in an orthogonal direction orthogonal to the circumferential direction, and the annular portion is formed by (i) one of the first conductive portion and the second conductive portion connected to the resistor body in the circumferential direction and (ii) the resistor body.

5. The variable resistor of claim 1, wherein each of the first conductive portion and the second conductive portion is connected to the resistor body in an orthogonal direction orthogonal to the circumferential direction, and the annular portion is provided by forming the resistor body continuously in an annular shape along the circumferential direction.

6. The variable resistor of claim 1, wherein a separation distance between the first conductive portion and the second conductive portion on one end along the circumferential direction is longer than a separation distance between the first conductive portion and the second conductive portion on an other end along the circumferential direction.

7. An electronic device, for determining a rotation position of a slider of a variable resistor in a circumferential direction, the electronic device comprising:

a main body and a rotating part that are vertically separated from each other and face each other, wherein the main body includes:

a substrate having: a first main surface facing vertically upward, a second main surface facing vertically downward, and a through hole vertically penetrating the first main surface and the second main surface in one direction;

a first conductive portion and a second conductive portion provided on the first main surface, arranged apart from each other in a circumferential direction, and to which a predetermined voltage is applied;

a resistor body provided on the first main surface and connected to each of the first conductive portion and the second conductive portion;

an electrode provided on the first main surface and located on a through-hole side relative to the resistor body; and a third conductive portion provided on each of the second main surface and a partition wall surface and configured to partition the through hole and connect to the electrode, and the rotating part includes:

an opposing part that faces the first main surface in vertical direction and rotates in the circumferential direction around a vertical rotation axis, the slider located on an opposing surface on a first main surface side of the opposing part, and configured to conductively slide on the electrode as the opposing part rotates in the circumferential direction, and to conductively slide on an annular portion that extends continuously along the circumferential direction around the through hole and formed by (i) the resistor body alone or (ii) the resistor body and a portion of at least one of the first conductive portion and the second conductive portion;

a rotation direction memory part configured to store the rotation direction of the part;

a voltage change detection part configured to detect an amount of change in voltage applied to a portion of the resistor body between the first conductive portion and the slider; and a position determination part configured to determine the rotation position of the slider in the circumferential direction based on an output results of the rotation direction storage unit and the voltage change detection unit.

8. An electronic device, for determining a rotation position of a slider of a variable resistor in a circumferential direction, the electronic device comprising:

a main body and a rotating part that are vertically separated from each other and face each other, wherein the main body includes:

a substrate having a first main surface facing vertically upward, a second main surface facing vertically downward, and a through hole vertically penetrating the first main surface and the second main surface;

a first conductive portion and a second conductive portion provided on the first main surface, arranged apart from each other in a circumferential direction, and to which a predetermined voltage is applied;

a resistor body provided on the first main surface and connected to each of the first conductive portion and the second conductive portion; and a third conductive portion provided on the first main surface and provided with a connection terminal extending away from the first main surface, and the rotating part includes:

an opposing part including an opposing surface that faces the first main surface, and that rotates in the circumferential direction; and an electrode formed in an annular shape along the circumference direction and configured to conductively slide on the connection terminal as the opposing part rotates, which is provided on the opposing surface on a first main surface side of the opposing part, and located on one side away from the resistor body than the through hole in the orthogonal direction orthogonal to the circumferential direction, and the slider is connected to the electrode and is configured to conductively slide on the annular portion that extends continuously in the circumferential direction around the through hole and formed by (i) the resistor body alone or (ii) the resistor body and a portion of at least one of the first conductive portion and the second conductive portion, wherein the electronic device is further provided with:

a rotation direction detection memory part that stores the rotation direction of the part;

a voltage change detection part configured to detect an amount of change in voltage applied to a portion of the resistor body between the first conductive portion and the slider; and a position determination part configured to determine the rotation position of the slider in the circumferential direction based on an output results of the rotation direction storage unit and the voltage change detection unit.

9. The electronic device of claim 7, further comprising:

a voltage memory part that stores a voltage of a portion of the resistor body between the first conductive portion and the slider, which is picked up at a position configured to mechanically stop the rotation of the opposing part.

10. The electronic device of claim 9, further comprising:

a rotation number memory part that stores the rotation number from a position/configured to mechanically stop the rotation of the opposing part.

11. The variable resistor of claim 1, further comprising:

a processor; and a computer-readable storage medium, wherein the variable resistor is configured to have a voltage versus rotation curve including a central peak associated with a peak voltage.

12. The variable resistor of claim 11, wherein the voltage versus rotation curve includes:

a first rotation position associated with a first operation mode;

a second rotation position associated with a second operation mode, and greater than the first rotation position;

a third rotation position associated with a third operation mode, greater than the second rotation position, and associated with the peak voltage;

a fourth rotation position associated with a fourth operation mode, and greater than the third rotation position; and a fifth rotation position associated with a fifth operation mode and greater than the fourth rotation position.

13. The variable resistor of claim 12, wherein:

the first operation mode is a face mode;

the second operation mode is a bi-level mode;

the third operation mode is a foot mode;

the fourth operation mode is a face and defrost mode; and the fifth operation mode is a defrost mode.

14. The variable resistor of claim 13, wherein:

the first rotation position is associated with a first voltage value;

the second rotation position is associated with a second voltage value;

the third rotation position is associated with the peak voltage;

the fourth rotation position is associated with the second voltage value; and the fifth rotation position is associated with the first voltage value.

15. The variable resistor of claim 14, wherein the variable resistor is configured to:

store a present voltage;

store a present rotation direction associated with a rotation instruction;

detect a new voltage after a small rotation in the present rotation direction; and determine a new rotation position based at least partly upon:

(i) the stored present voltage;

(ii) the new voltage; and (iii) the stored rotation direction.

* * * * *